US011930977B2

(12) United States Patent
Libman et al.

(10) Patent No.: US 11,930,977 B2
(45) Date of Patent: Mar. 19, 2024

(54) CLEANING SYSTEM

(71) Applicant: The Libman Company, Arcola, IL (US)

(72) Inventors: Aaron Libman, Champaign, IL (US); Andrew D. Libman, Champaign, IL (US); Jon Franklin, St. Joseph, IL (US); Roberto Pellacini, Torrechiara Langhirano (IT)

(73) Assignee: The Libman Company, Arcola, IL (US)

( * ) Notice: Subject to any disclaimer, the term of this patent is extended or adjusted under 35 U.S.C. 154(b) by 45 days.

(21) Appl. No.: 17/306,355

(22) Filed: May 3, 2021

(65) Prior Publication Data

US 2022/0346621 A1 Nov. 3, 2022

(51) Int. Cl.
*A47L 13/12* (2006.01)
*A47L 13/146* (2006.01)
*A47L 13/257* (2006.01)

(52) U.S. Cl.
CPC ..... *A47L 13/12* (2013.01); *A47L 13/146* (2013.01); *A47L 13/257* (2013.01)

(58) Field of Classification Search
CPC ..... A47L 13/12; A47L 13/146; A47L 13/257; A46B 5/0095; A46B 7/042
USPC ..... 15/115, 406, 146, 176.6, 403, 114
See application file for complete search history.

(56) References Cited

U.S. PATENT DOCUMENTS 3,289,233 A 12/1966 Smyth
D280,769 S 9/1985 Johnson et al.
4,552,476 A 11/1985 Heraty et al.
D295,912 S 5/1988 Jones et al.
D302,759 S 8/1989 Batchelor
5,161,772 A 11/1992 DiResta et al.
D334,263 S 3/1993 Torres
D389,625 S 1/1998 Feldman et al.
D401,702 S 11/1998 Berti
D410,783 S 6/1999 Camp, Jr. et al.
6,026,530 A 2/2000 Camp, Jr.
6,061,863 A 5/2000 Chen
6,336,240 B1 * 1/2002 Laux ..... A47L 13/12 15/118
6,513,844 B1 2/2003 Hsu
D480,564 S 10/2003 Petner
D497,228 S 10/2004 Berti
D497,229 S 10/2004 Berti
(Continued)

FOREIGN PATENT DOCUMENTS

EP 1142526 A1 10/2001

*Primary Examiner* — Eric J Rosen
*Assistant Examiner* — Tyler James McFarland
(74) *Attorney, Agent, or Firm* — Banner & Witcoff, Ltd.

(57) ABSTRACT

Aspects described herein generally relate to a cleaning system, such as a cleaning implement with a primary cleaning member and a removable secondary cleaning member, in particular a mop assembly with a primary cleaning member and a removable secondary cleaning member. The primary cleaning member may be a sponge based cleaning member and the secondary cleaning member may be a scrubbing brush or similar handheld scrubbing member. The scrubbing brush may have an attachment member that includes a pair of rails and a tab assembly that helps to releasably connect the scrubbing brush to a connecting member of the mop assembly.

12 Claims, 12 Drawing Sheets

(56) References Cited

U.S. PATENT DOCUMENTS

| | | | | |
|---|---|---|---|---|
| D497,230 | S | 10/2004 | Berti | |
| D507,855 | S | 7/2005 | Libman et al. | |
| 6,983,509 | B2 | 1/2006 | Lin | |
| D520,698 | S | 5/2006 | Libman et al. | |
| D531,367 | S | 10/2006 | Hay | |
| D544,161 | S | 6/2007 | Weaver | |
| D548,908 | S | 8/2007 | Berti | |
| 7,260,864 | B1 * | 8/2007 | Morad | A47L 13/144 15/118 |
| 7,334,285 | B1 | 2/2008 | Morad et al. | |
| 7,555,803 | B2 | 7/2009 | Libman | |
| D606,270 | S | 12/2009 | Weis et al. | |
| D607,169 | S | 12/2009 | Weis et al. | |
| 7,748,074 | B2 | 7/2010 | Guizzi | |
| D627,118 | S | 11/2010 | Bensussan et al. | |
| D657,928 | S | 4/2012 | Byrne | |
| D661,040 | S | 5/2012 | Pellacini | |
| 8,713,742 | B2 * | 5/2014 | Pellacini | A47L 13/257 15/116.2 |
| D782,203 | S | 3/2017 | Fortier et al. | |
| D796,139 | S | 8/2017 | Fortier et al. | |
| D829,398 | S | 9/2018 | Niedzwecki et al. | |
| D832,542 | S | 10/2018 | Larouche | |
| D871,006 | S | 12/2019 | Schechter et al. | |
| D897,620 | S | 9/2020 | Libman et al. | |
| D912,919 | S | 3/2021 | Tinius | |
| D922,712 | S | 6/2021 | Harrington et al. | |
| D930,309 | S | 9/2021 | Libman et al. | |
| 2002/0029433 | A1 | 3/2002 | Libman | |
| 2004/0187240 | A1 | 9/2004 | Berti et al. | |
| 2009/0139041 | A1 * | 6/2009 | Weis | A47L 13/146 15/119.2 |
| 2014/0084079 | A1 * | 3/2014 | Lenkiewicz | A47L 11/4083 239/102.1 |
| 2018/0042374 | A1 | 2/2018 | Nudelman | |
| 2021/0282618 | A1 | 9/2021 | Libman | |

* cited by examiner

CLEANING SYSTEM

FIELD

Aspects described herein generally relate to a cleaning system, such as a cleaning implement with a primary cleaning member and a removable secondary cleaning member, in particular a mop system with a primary cleaning member and a removable secondary cleaning member.

BACKGROUND

Mops are used for cleaning all types of surfaces. However, in some instances, a soiled surface may require additional scrubbing force to be applied in order to loosen the soiling material such that it may be mopped up. For hard to reach areas, a hand held cleaning and/or scrubbing member may be useful.

BRIEF SUMMARY

In light of the foregoing background, the following presents a simplified summary of the present disclosure in order to provide a basic understanding of some aspects of the various implementations of this disclosure. This summary is not an extensive overview of the embodiments described herein. It is not intended to identify key or critical elements, or to delineate the scope of the embodiments described in this disclosure. The following summary merely presents some concepts of the embodiments of this disclosure in a simplified form as a prelude to the more detailed description provided below.

Aspects of this disclosure may relate to a mop assembly that includes a handle assembly, where the handle assembly has a handle member having a first end and a second end opposite the first end, and a connecting member having a handle receiver connected to the first end of the handle member, where the connecting member has a front side, a rear side opposite the front side, and a bottom side between the front side and the rear side arranged opposite the handle receiver. The bottom side may include a primary receiver and the front side may include a brush receiver. The mop assembly may further include a wringing mechanism connected to the primary receiver, a flexible cleaning member connected to the primary receiver, where the wringing mechanism is configured to wring any excess moisture from the flexible cleaning member, and a scrubbing brush releasably attached to the brush receiver, where the scrubbing brush may include a base structure and an attachment structure. A plurality of bristles may extend from a front side of the base structure. The brush receiver may include: (a) a base surface; (b) a first engaging member extending from the front side of the connecting member above a first portion of the base surface, where a first slot is created between the first engaging member and the base surface; and (c) a second engaging member extending from the front side of the connecting member above a second portion of the base surface, where a second slot is created between the second engaging member and the base surface. The brush receiver may also include a first retention member located on an outward facing surface of the front side of the connecting member, and the attachment structure of the scrubbing brush may include a tab assembly connected to the base structure of the scrubbing brush, where the tab assembly may engage the retention member to help secure the scrubbing brush to the connecting member. The brush receiver may also include a second retention member that extends upward from the base surface of the brush receiver, where the attachment structure may include a central engagement member that contacts the second retention member to help secure the scrubbing brush to the connecting member. The base structure of the scrubbing brush may include a rear side opposite the front side, a top side extending between the front side and the rear side, a bottom side opposite the top side, a first end extending between the top side and bottom side, and a second end opposite the first end, and the attachment structure may include a pair of rails may be located on the rear side. The pair of rails may include: (a) a first rail, the first rail having a first rear surface, a first outboard surface, a first inboard surface, where the first inboard surface may diverge from the first outboard surface, and (b) a second rail, the second rail having a second rear surface, a second outboard surface, a second inboard surface, where the second inboard surface may diverge from the first outboard surface, and where the first outboard surface and the second outboard surface may be generally parallel to each other. A rail distance may be greater than a brush width, wherein the rail distance is a minimum distance between the first outboard surface and the second outboard surface. The first rail may have a first outward facing surface extending from the top side of the base structure towards the first outboard surface, and the second rail may have a second outward facing surface extending from the bottom side of the base surface towards the second outboard surface. The first outward facing surface of the first rail may form a first acute angle with the first rear surface, and the second outward facing surface of the second rail may form a second acute angle with the second rear surface. When the scrubbing brush is slidably engaged with the brush receiver, the first outward facing surface may confront an inward facing surface of the first engaging member. The first rail may further include a first guide surface that extends between the first outboard surface and the first inboard surface, where the first guide surface forms an acute angle with the first inboard surface. The tab assembly may have a pivoting tab that includes: (a) a first end located furthest from the base structure of the scrubbing brush, (b) a second end opposite the first end located nearest the base structure, (c) an upper surface, (d) a lower surface opposite the upper surface, and (e) a pivot member extending from the lower surface. The pivot member may contact the outward facing surface of the front side of the connecting member to create a gap between the lower surface of the pivoting tab and the outward facing surface of the brush receiver. In some examples, the first retention member may be a raised protrusion extending from the outward facing surface of the brush receiver, where the first retention member has an engaging surface that confronts a stop surface on the pivoting tab. Optionally, the retention member may be received in a pocket located in the lower surface of the pivoting tab.

Still other aspects of this disclosure may relate a cleaning implement that comprises: (a) a handle assembly, where the handle assembly may include an elongated handle member and a lever connected to the handle member; (b) a connecting member having a handle receiver attached to an end of the handle member, where the connecting member may include a front side, a rear side opposite the front side, a bottom side between the front side and the rear side arranged opposite the handle receiver, where the bottom side may include a primary receiver and the front side includes a secondary receiver; (c) a wringing mechanism connected to the primary receiver of the connecting member, where movement of the wringing mechanism may be controlled by the lever; (d) a primary cleaning member that may be releasably engaged with the wringing mechanism, and (e) a secondary cleaning member releasably attached to the secondary receiver, where the secondary cleaning member may have a base structure with a cleaning structure extending from a first side of the base structure, a pair of rails located on a second side of the base structure, and a tab assembly located on a third side of the base structure, where the third side is located between the first side and the second side. The wringing mechanism may be configured to wring any excess moisture from the primary cleaning member by folding a first end of the primary cleaning member toward a second end of the primary cleaning member. The pair of rails may slidably engage a pair of slots of the secondary receiver, and the tab assembly may engage a retention member located on an outward facing surface of the secondary receiver to secure the secondary cleaning member to the connecting member. The tab assembly may include a pivoting tab with a first end located furthest from the base structure, a second end opposite the first end located nearest the base structure, an upper surface, a lower surface opposite the upper surface, and a pivot member extending from the lower surface. The pivot member may contact an outward facing surface of the secondary receiver creating a gap between the lower surface and the outward facing surface of the secondary receiver. The first retention member may be a raised protrusion extending from the outward facing surface of the secondary receiver, where the retention member may be received in a pocket located in the lower surface of the pivoting tab. In some examples, the first retention member may be a raised protrusion extending from the outward facing surface of the brush receiver, where the first retention member may include a ramped surface and an engaging surface opposite the ramped surface. The engaging surface of the first retention member may confront a stop surface that extends from a lower surface of the tab assembly. The primary cleaning member may be a sponge based cleaning member, and the secondary cleaning member may be a scrubbing brush. The secondary receiver may include: (a) a base surface; (b) a first engaging member extending from the first side above a first portion of the base surface, where a first slot of the pair of slots may be created between the first engaging member and the base surface; and (c) a second engaging member extending from the first side above a second portion of the base surface, where a second slot of the pair of slots may be created between the second engaging member and the base surface; and (d) a central engagement member that contacts the second retention member to help secure the secondary cleaning member to the connecting member, where the central engagement member may be located between the pair of rails.

Yet additional aspects of this disclosure may relate to a mop assembly comprising: (a) a handle assembly, where the handle assembly including an elongated handle member and a lever connected to the handle member; and (b) a connecting member having a handle receiver attached to an end of the handle member, where the connecting member may have a front side, a rear side opposite the front side, a bottom side between the front side and the rear side arranged opposite the handle receiver. The bottom side may include a primary receiver, and the front side may include a brush receiver. The brush receiver may have a base surface, a first engaging member may extend from the front side of the connecting member above a first portion of the base surface, where a first slot of a pair of slots may be created between the first engaging member and the base surface, and a second engaging member may extend from the front side of the connecting member above a second portion of the base surface, where a second slot of the pair of slots may be created between the second engaging member and the base surface. The brush receiver may also include a first retention member formed as a raised protrusion on an outward facing surface of the connecting member; and a second retention member extending upward from the base surface. The mop assembly may further include a wringing mechanism connected to the primary receiver of the connecting member, where movement of the wringing mechanism is controlled by the lever and a sponge based cleaning member that is releasably engaged with the wringing mechanism, where the wringing mechanism may be configured to wring any excess moisture from the sponge based cleaning member by folding a first end of the sponge based cleaning member toward a second end of the sponge based cleaning member. The mop assembly may also include a scrubbing brush releasably attached to the brush receiver, where the scrubbing brush may have a base structure with a plurality of bristles extending from a first side of the base structure, a pair of rails located on a second side of the base structure, and a tab assembly located on a third side of the base structure. The third side may be located between the first side and the second side. The pair of rails of the scrubbing brush may slidably engage the pair of slots of the brush receiver and the tab assembly may engage the first retention member located on an outward facing surface of the brush receiver to help secure the scrubbing brush to the connecting member. In addition, the central engagement member may contact the second retention member to help secure the scrubbing brush to the connecting member. The base structure, the pair of rails, and the tab assembly of the scrubbing brush may be formed as a unitary member. The tab assembly may include a pivoting tab with: (a) a pivoting tab with a first end located furthest from the base structure, (b) a second end opposite the first end located nearest the base structure, (c) an upper surface, (d) a lower surface opposite the upper surface, and (e) a pivot member extending from the lower surface, wherein the pivot member contacts the outward facing surface of the connecting member creating a gap between the lower surface and the outward facing surface of the connecting member.

BRIEF DESCRIPTION OF THE DRAWINGS

The present disclosure is illustrated by way of example and not limited in the accompanying figures in which like reference numerals indicate similar elements and in which.

DETAILED DESCRIPTION

Figure 1:
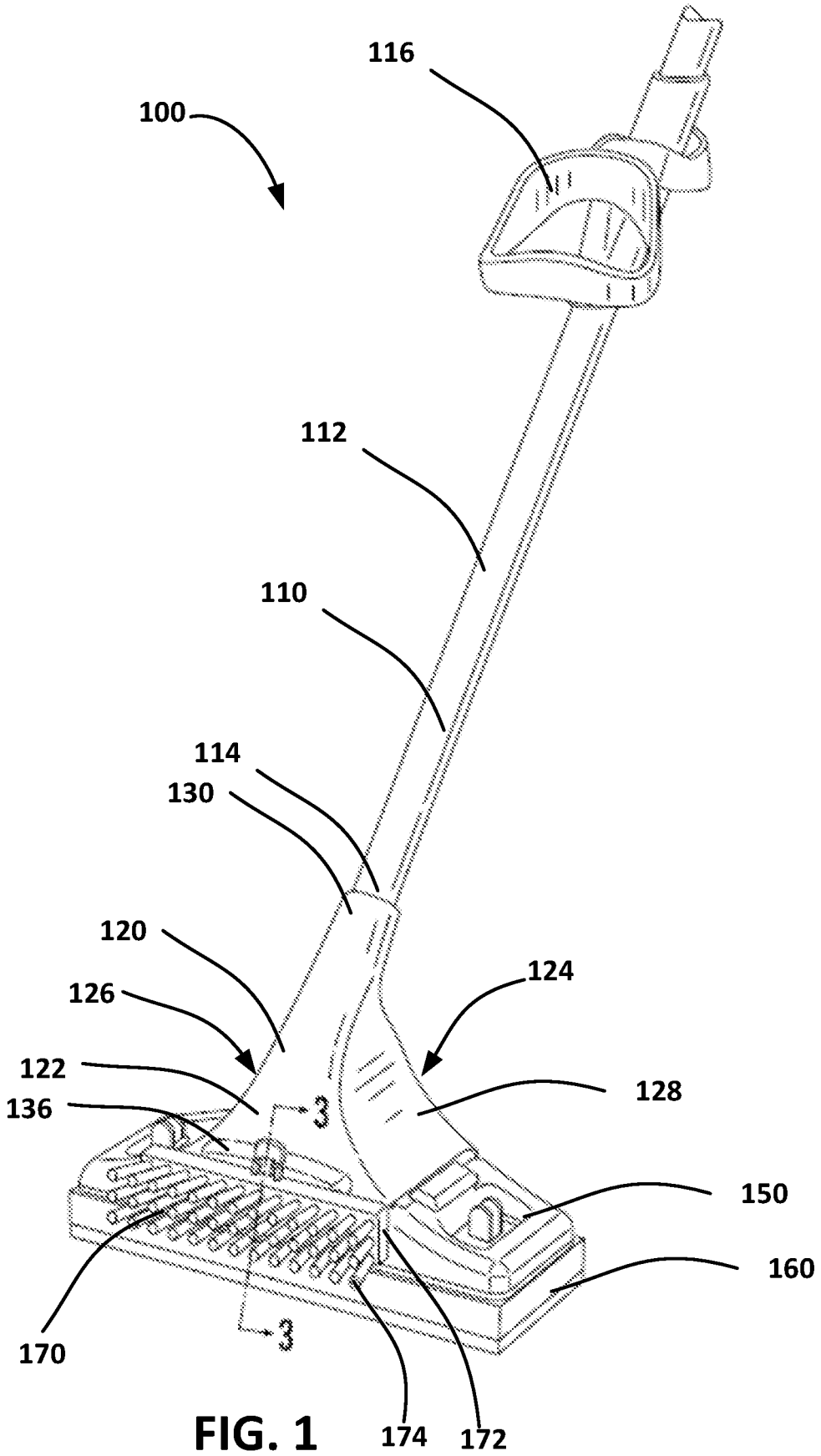
FIG. 1 illustrates a perspective view of an exemplary cleaning implement, according to one or more aspects described herein.
Figure 2:
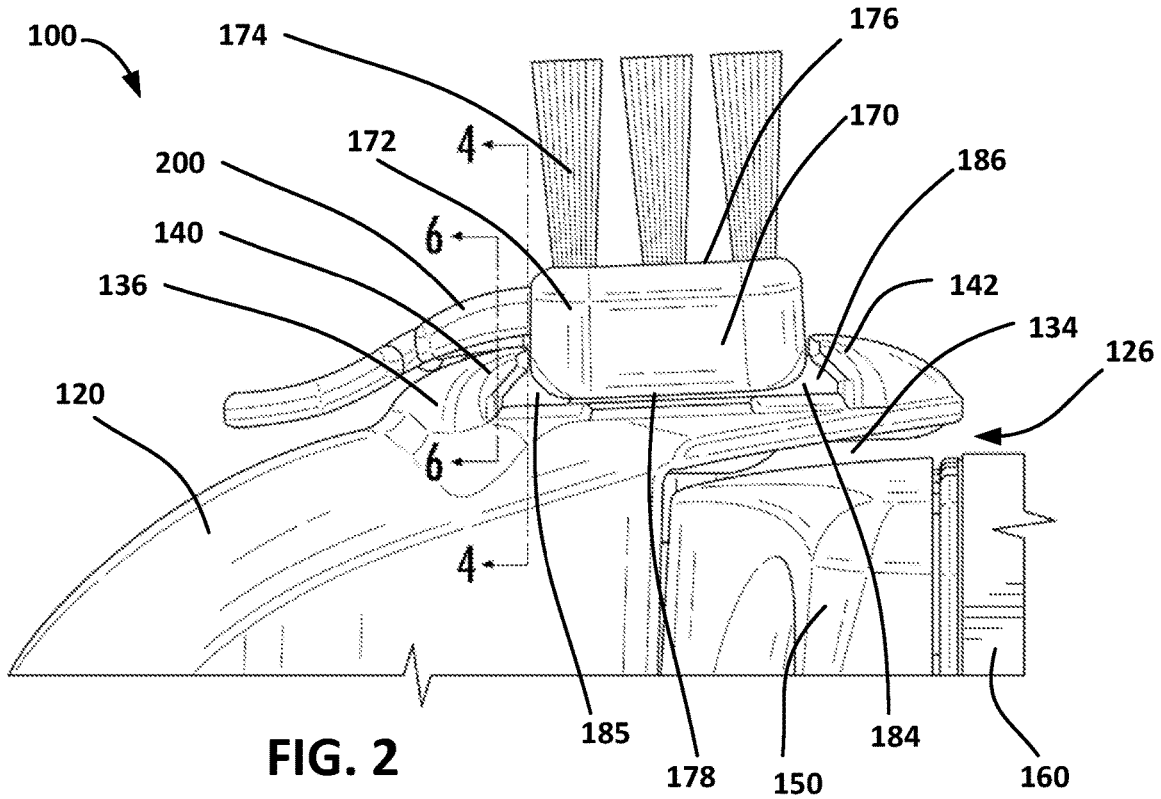
FIG. 2 illustrates a side view of a portion of the exemplary cleaning implement of FIG. 1, according to one or more aspects described herein.
Figure 3:
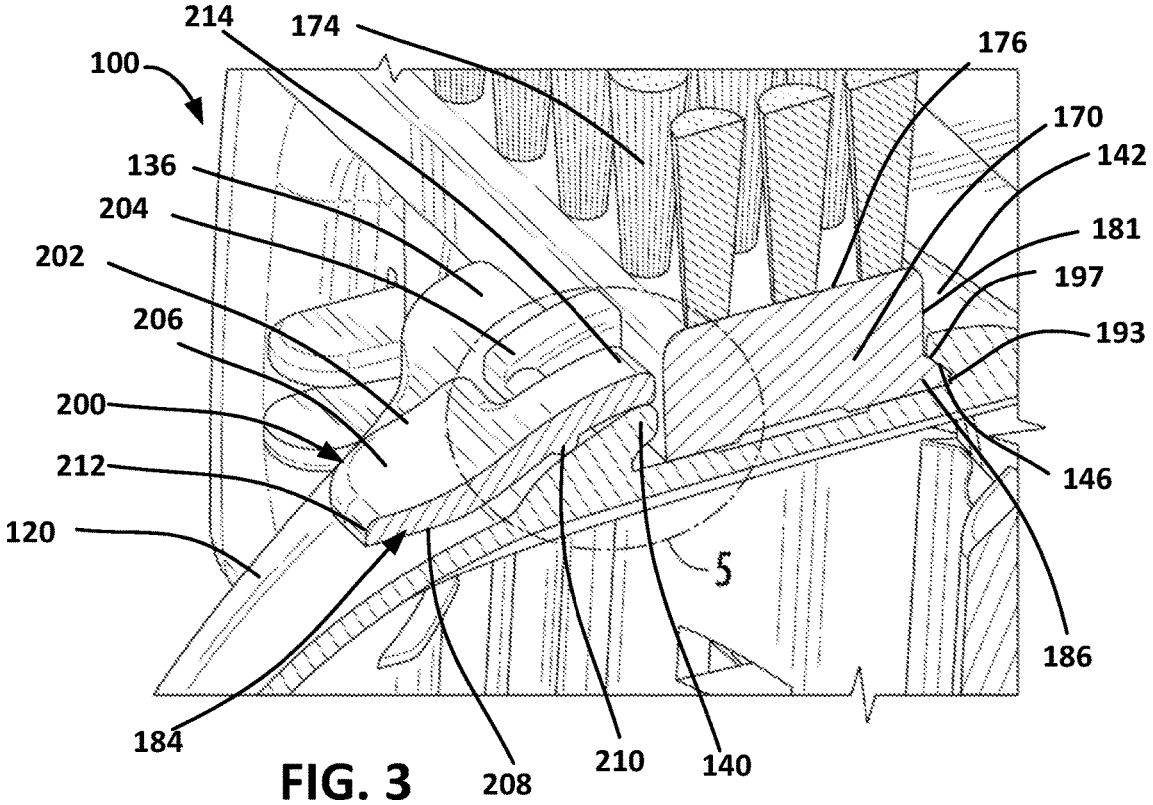
FIG. 3 illustrates a cross-sectional perspective view of the exemplary cleaning implement of FIG. 1 along the line 3-3, according to one or more aspects described herein.
Figure 4:
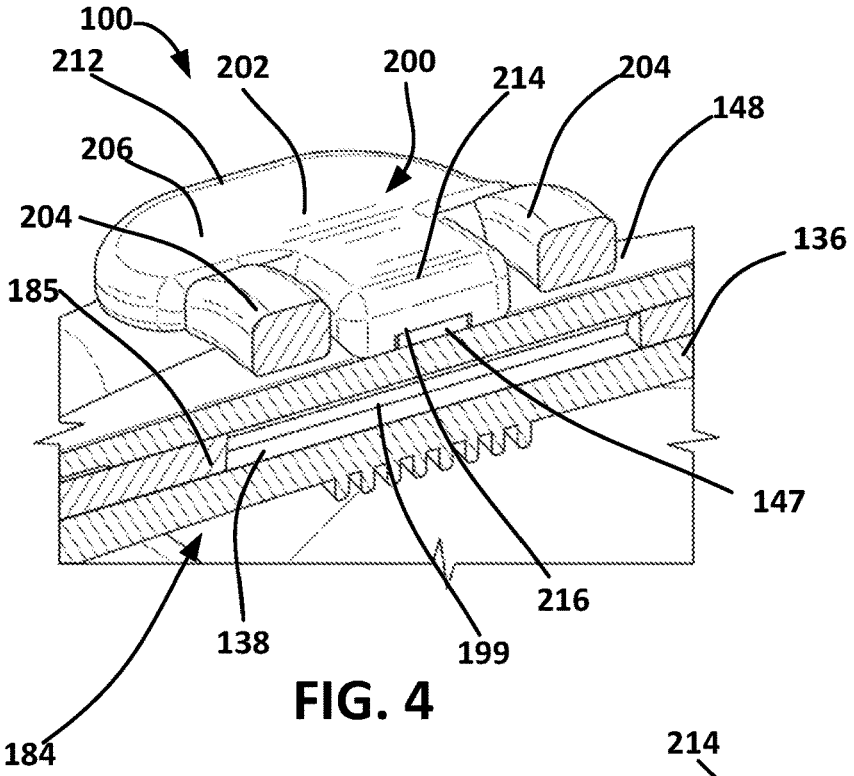
FIG. 4 illustrates a cross-sectional perspective view of the exemplary cleaning implement of FIG. 1 along the line 4-4 of FIG. 2, according to one or more aspects described herein.
Figure 5:
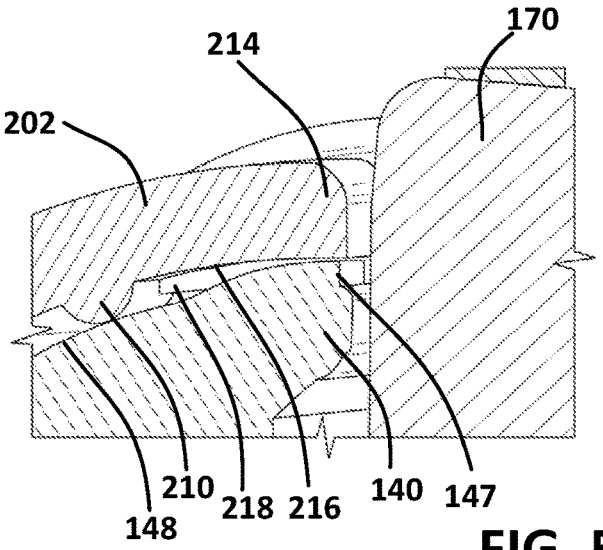
FIG. 5 illustrates an enlarged perspective cross-sectional view of a portion of the exemplary cross-sectional view of FIG. 3, according to one or more aspects described herein.
Figure 6:
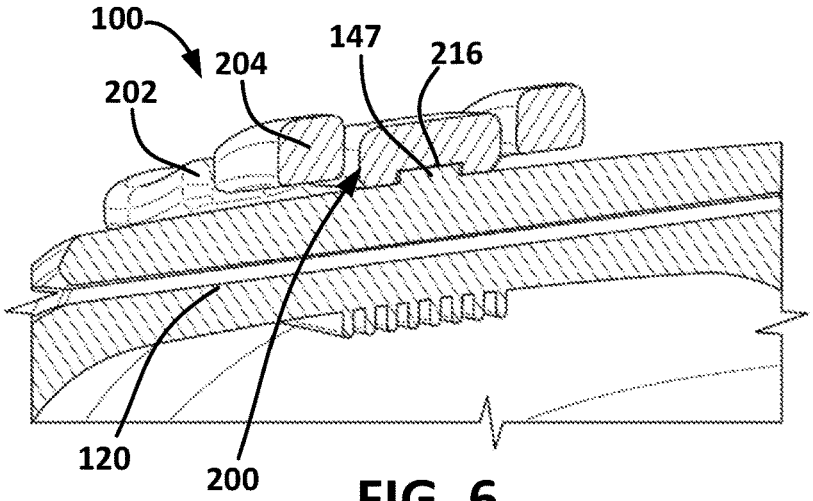
FIG. 6 illustrates a cross-sectional perspective view of the exemplary cleaning implement of FIG. 1 along the line 6-6 of FIG. 2, according to one or more aspects described herein.

In the following description of various example structures, reference is made to the accompanying drawings, which form a part hereof, and in which are shown by way of illustration various example cleaning implements, wringers, and connection assemblies in accordance with various embodiments Additionally, it is to be understood that other specific arrangements of parts and structures may be utilized and structural and functional modifications may be made without departing from the scope of this disclosure. Also, while the terms "upper," "lower," "front," "back," "rear," "top," "bottom," and the like may be used in this specification to describe various example features and elements, these terms are used herein as a matter of convenience, e.g., based on the example orientations shown in the figures and/or the orientations in typical use. It is noted that the accompanying drawings may not be drawn to scale. It is noted that various connections between elements are discussed in the following description. It is noted that these connections are general and, unless specified otherwise, may be direct or indirect, and that the specification is not intended to be limiting in this respect.

The following terms are used in this specification, and unless otherwise noted or clear from the context, these terms have the meanings provided below.

"Plurality," as used herein, indicates any number greater than one, either disjunctively or conjunctively, as necessary, up to an infinite number.

"Generally perpendicular" means that a first line, segment, plane, edge, surface, etc. is approximately (in this instance, within 5%) orthogonal with another line, plane, edge, surface, etc., over at least 50% of the length of the first line, segment, plane, edge, surface, etc.

"Generally parallel" means that a first line, segment, plane, edge, surface, etc. is approximately (in this instance, within 5%) equidistant with another line, plane, edge, surface, etc., over at least 50% of the length of the first line, segment, plane, edge, surface, etc.

"Generally planar" means that a surface is level and aligned with another surface, such that the two surfaces form a substantially flat single surface, within a tolerance of +/−0.05 inches.

FIGS. 1-6 illustrate an example of a cleaning system or cleaning implement 100, according to one or more aspects described herein. The exemplary cleaning implement 100 may comprise a mop assembly 100 that includes a primary cleaning member 160 and a removable secondary cleaning member 170 that allows a user additional cleaning options. The mop assembly 100 may include a handle assembly 110 that connects to a connecting member 120, where the connecting member 120 may be configured to a wringing mechanism 150. The primary cleaning member 160 may be connected to the wringing mechanism 150, where the wringing mechanism 150 may be configured to wring the primary cleaning member 160 of any excess liquid by squeezing and/or folding the primary cleaning member 160. The secondary cleaning member 170 may be releasably secured to the connecting member 120 of the mop assembly 100. The primary cleaning member 160 may be a sponge based cleaning member, while the secondary cleaning member 170 may be a handheld cleaning member such as a scrubbing brush, a scrubbing pad, or similar cleaning member. In the illustrative examples, the secondary cleaning member 170 is shown as a scrubbing brush 170.

The mop assembly 100 may be used as a conventional mop to clean floors or other surfaces that require cleaning using the primary cleaning member 160. However, in situations where a surface may be difficult to clean, the removable scrubbing brush 170 may provide a user another option to effectively clean the surface while being easily retained by the mop assembly 100 to be readily available for use. For example, the scrubbing brush 170 may be used to clean areas that are not accessible unless the brush 170 is removed from the connecting member 120. As another option, the scrubbing brush 170 may be used while attached to the connecting member 120 of the mop assembly 100.

The handle assembly 110 of the cleaning implement 100 may include a handle member 112, with a lever 116 connected to the handle member 112. The handle member 112 may include a first end 114, a second end opposite the first end 114, where the first end 114 may be connected to a handle receiver 130 of the connecting member 120. A grip or similar member located on the handle member 112 nearer the second end may provide a place for a user's hands to easily grasp and use the mop assembly 100. The lever 116 may be connected to the wringing mechanism 150 and may be configured to control the movement of the wringing mechanism 150. For instance, the lever 116 may have a usage position where the wringing mechanism 150 allows the primary cleaning member 160 to be in a substantially flat or planar orientation to clean the intended surface and a wringing position, where the lever 116 may be pulled upward to cause the wringing mechanism 150 to squeeze and/or fold the ends 164, 166 of the primary cleaning member 160 toward each other to wring or squeeze any excess moisture, like water or cleaning solution, out of the primary cleaning member 160. The lever 116 may be connected to the wringing mechanism 150 via rods or cables that extend inside a hollow portion of the handle member 112 and a hollow portion of the connecting member 120. The operation of a wringing mechanism 150 by a lever 116 may be known to one skilled in the art. For example, U.S. patent application Ser. No. 13/191,133 filed on Jul. 26, 2011, now U.S. Pat. No. 8,713,742 issued on May 6, 2014 describes the operation of a wringing mechanism by a lever on a mop assembly. Accordingly, U.S. Pat. No. 8,713,742 is incorporated by reference in its entirety. The handle member 112 may have an elongated shape and may be a lightweight hollow metal tube. Alternatively, any rigid structure formed from wood or a polymeric material may be used for the handle member 112.

FIGS. 2-6 illustrate the releasable connection between the secondary cleaning member 170 and the connecting member 120 of the mop assembly 110. The scrubbing brush 170 may include a base structure 172 with a plurality of bristles 174 that extend from a front side 176 of the base structure 172 and an attachment structure 184. The attachment structure 184 may allow the scrubbing brush 170 to be removably coupled to the connecting member 120 of the mop assembly 100. The attachment structure 184 may include a pair of rails 185, 186 along with a tab assembly 200, where each rail 185, 186 may be slidably engaged with the secondary receiver 136 of the connecting member 120. The pair of rails 185, 186 may include a first rail 185 arranged along the rear side 178 and/or the top side 180 of the base structure 172 and a second rail 186 may be arranged along the rear side 178 and/or the bottom side 181 of the base structure 172. For example, rail 185 may slidably engage with a first opening 143 created between a first engaging member 140 and a base surface 138 of the secondary receiver 136, and rail 186 may slidably engage with a second opening 144 created between a second engaging member 142 and the base surface 138. The two rails 185, 186 and two engaging members 140, 142 may be arranged on opposite sides of a central plane 173 of the scrubbing brush 170. In some cases, the two rails 185, 186 and the two engaging members 140, 142 may be mirror images relative to the central plane 173.

In order to limit the sliding movement of the scrubbing brush 170, a retention member 147 may be located on an outward facing surface 148 of the first engaging member 140 of the secondary receiver 136 on the front side 122 of the connecting member 120. The retention member 147 may be a raised protrusion extending from the outward facing surface 148 of the secondary receiver 136. To secure the scrubbing brush 170 to the secondary receiver 136, the retention member 147 may be received in a pocket 216 located on a lower surface 208 of a pivoting tab 202. A center of the retention member 147 may be substantially centered along a length, L1, of the first engaging member 140. Alternatively, the center of the retention member 147 may be offset, such that the center of the retention member 147 is closer to a first end of the first engaging member 140 than a second end of the first engaging member 140.

The scrubbing brush 170 may be releasably engaged to a front side 122 of the connecting member 120. In some examples, the scrubbing brush 170 may be releasably engaged to a rear side 124 or on of the other sides of the connecting member 120. In addition, the connecting member 120 may have a primary receiver 134 on a lower side 132.

Figure 7:
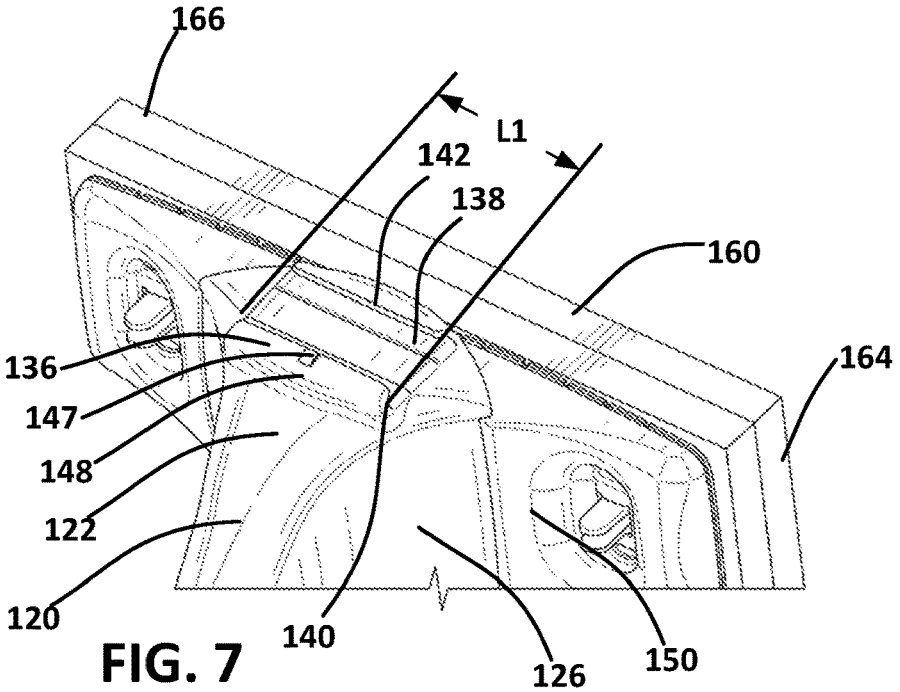
FIG. 7 illustrates a perspective view of a portion of a mop component of the exemplary cleaning implement of FIG. 1, according to one or more aspects described herein.
Figure 8:
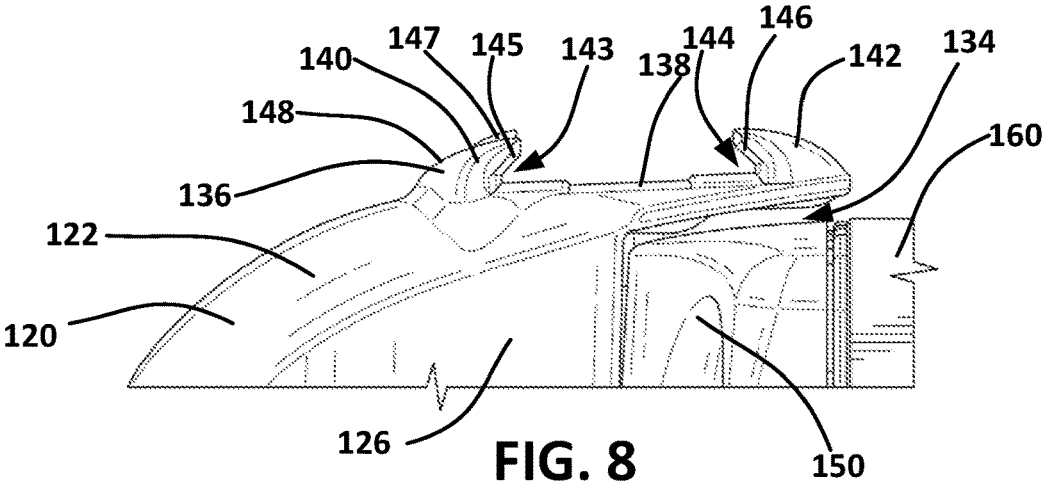
FIG. 8 illustrates a side view of a portion of a mop component of FIG. 7, according to one or more aspects described herein.
Figure 9:
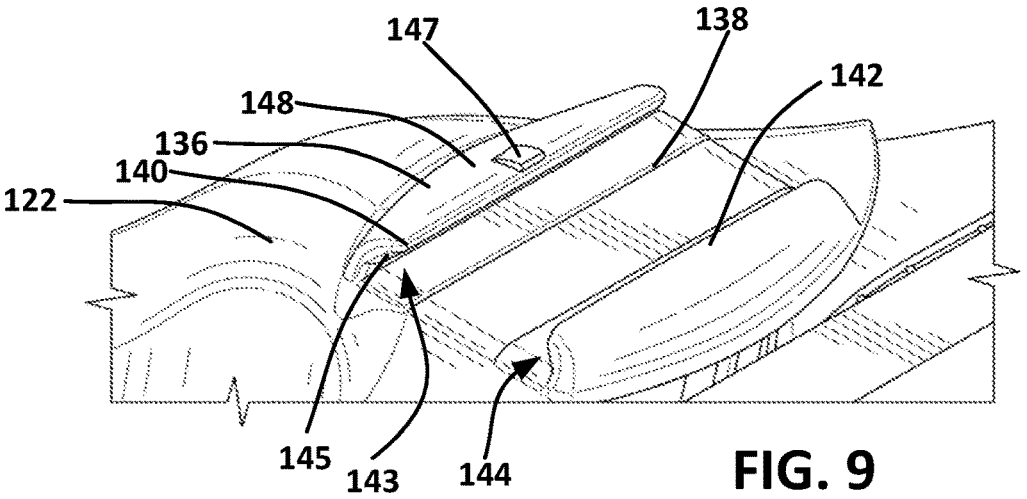
FIG. 9 illustrates a perspective view of a portion of a mop component of FIG. 7, according to one or more aspects described herein.
Figure 10:
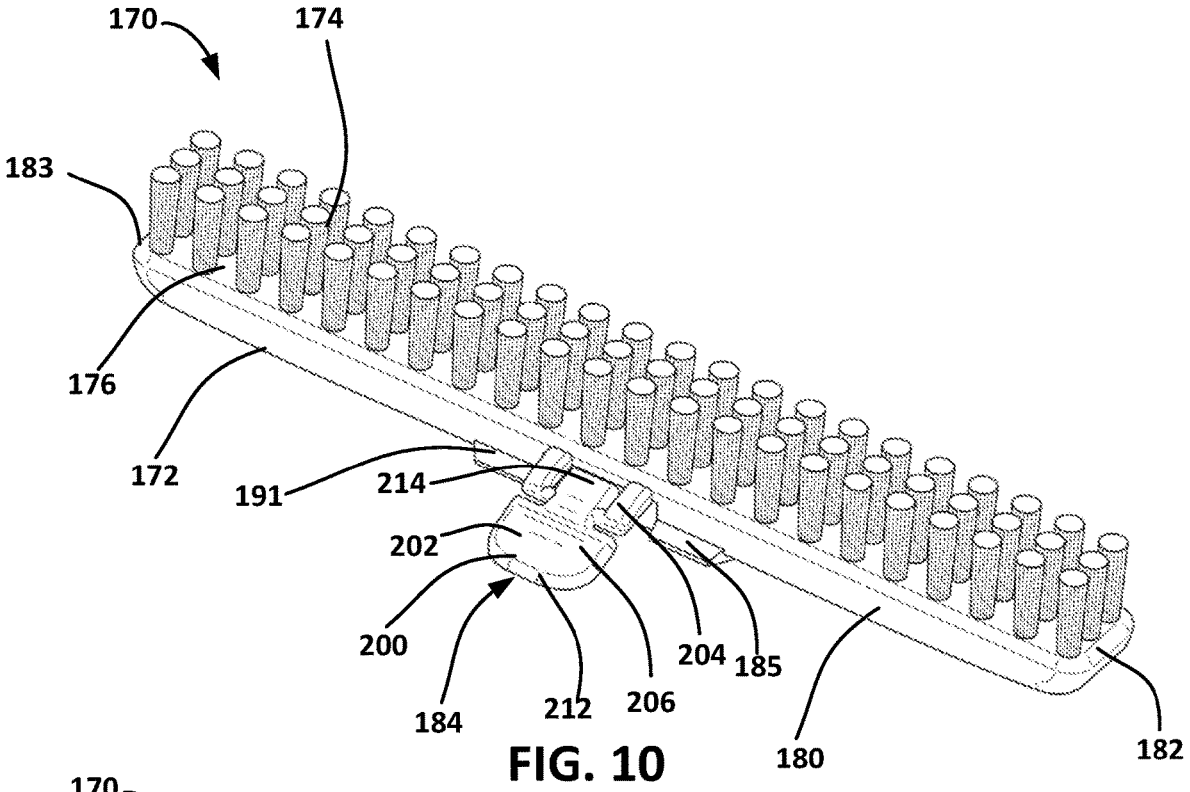
FIG. 10 illustrates a perspective view of a scrubbing brush component of the exemplary cleaning implement of FIG. 1, according to one or more aspects described herein.
Figure 11:
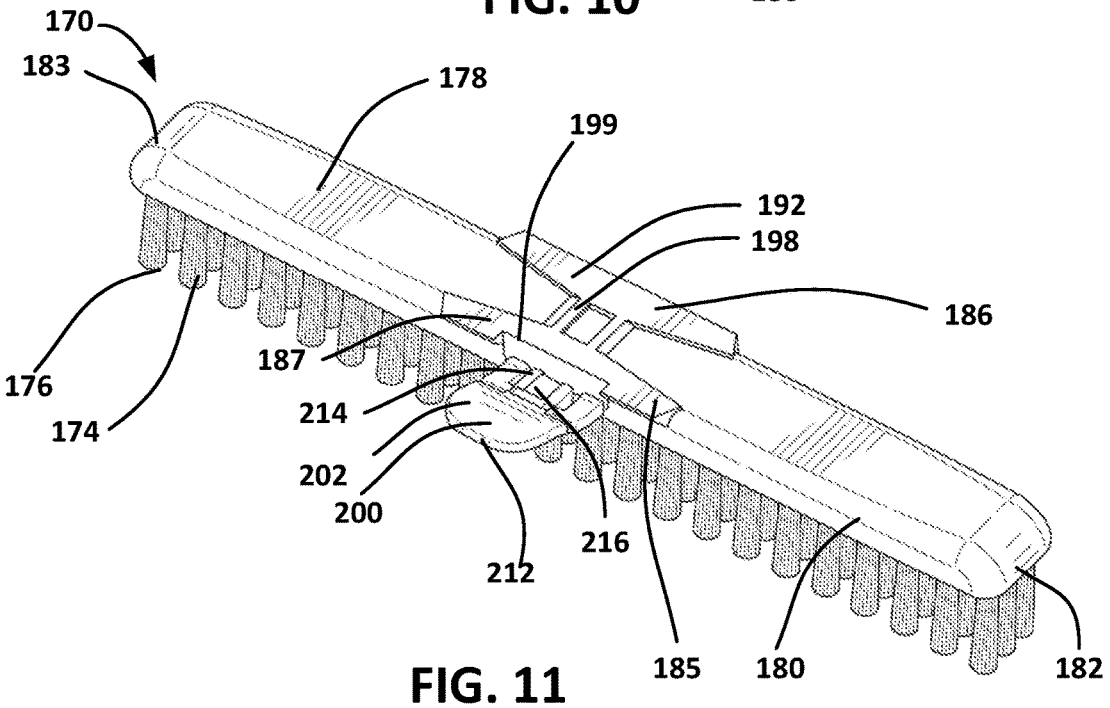
FIG. 11 illustrates a perspective view of the scrubbing brush component of FIG. 10, according to one or more aspects described herein.
Figure 12:
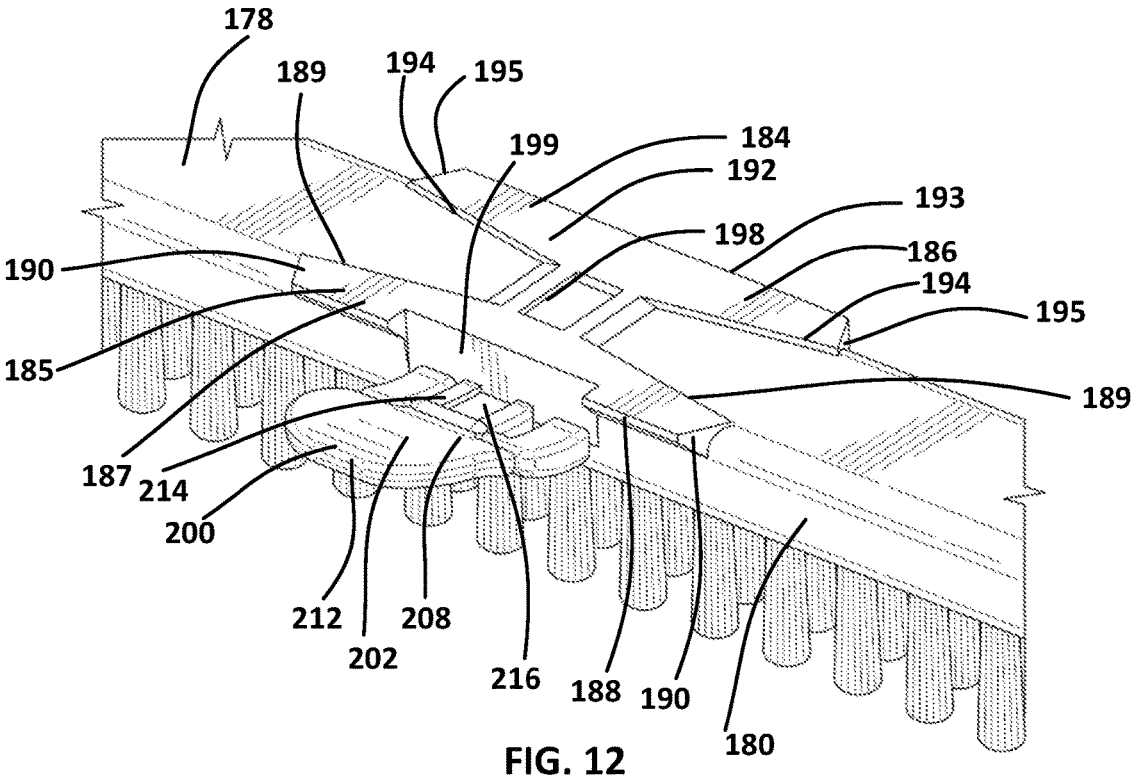
FIG. 12 illustrates an enlarged perspective view of a portion of a scrubbing brush component of FIG. 10, according to one or more aspects described herein.
Figure 13:
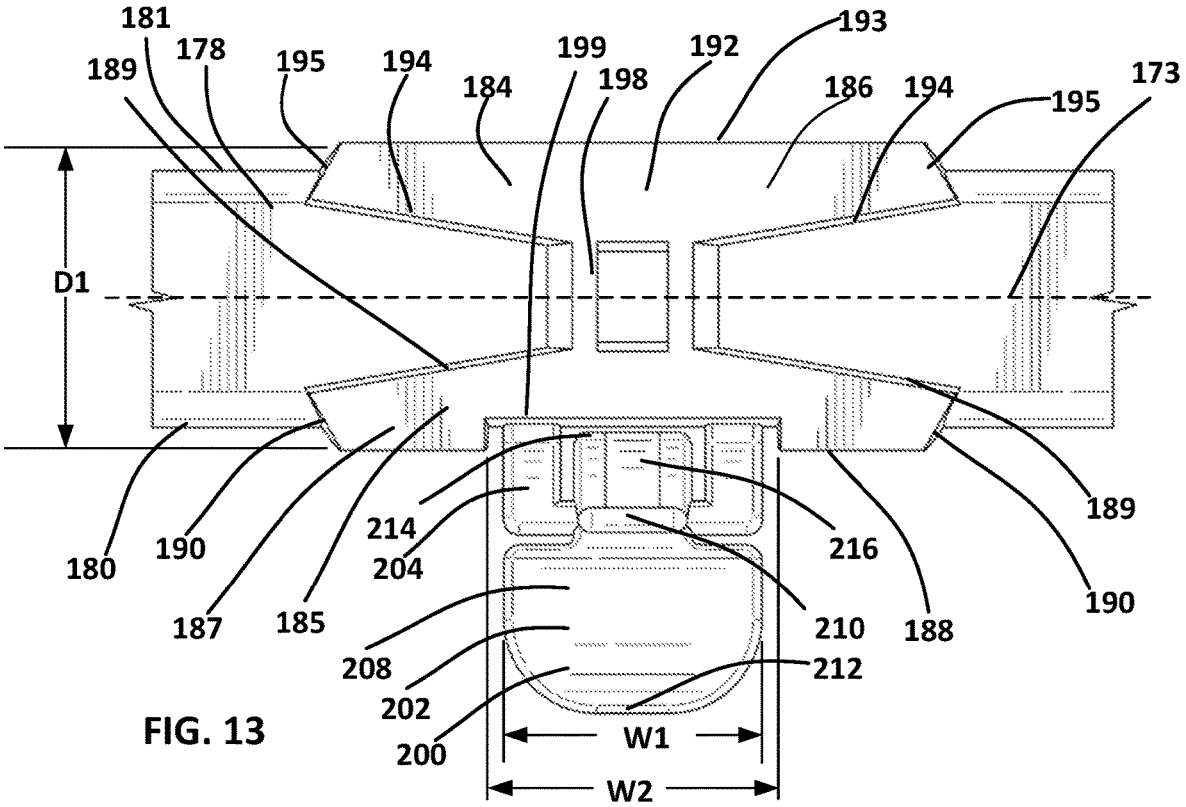
FIG. 13 illustrates a top view of a portion of a scrubbing brush component of FIG. 10, according to one or more aspects described herein.
Figure 14:
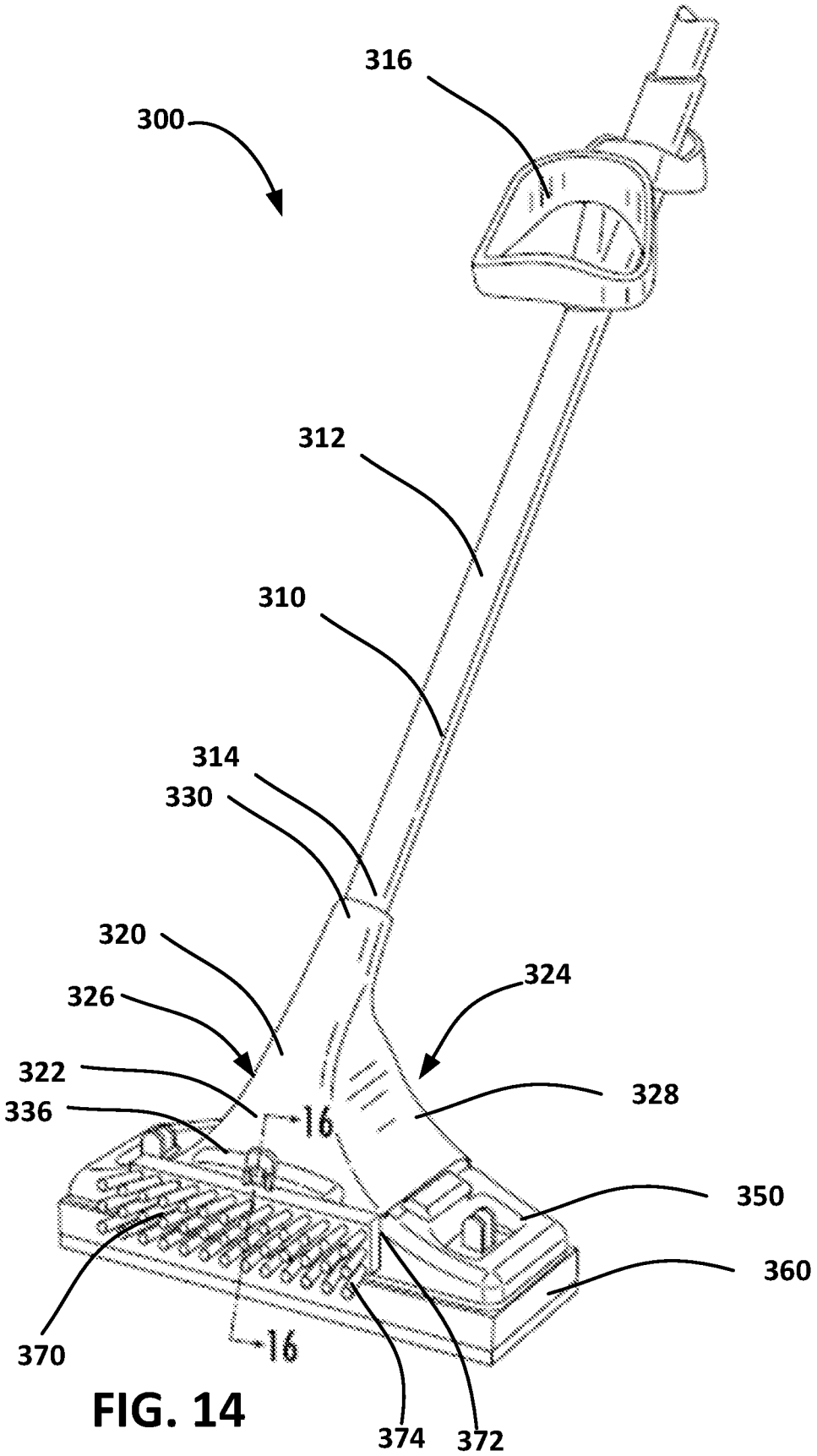
FIG. 14 illustrates a perspective view of an alternate exemplary cleaning implement, according to one or more aspects described herein.
Figure 15:
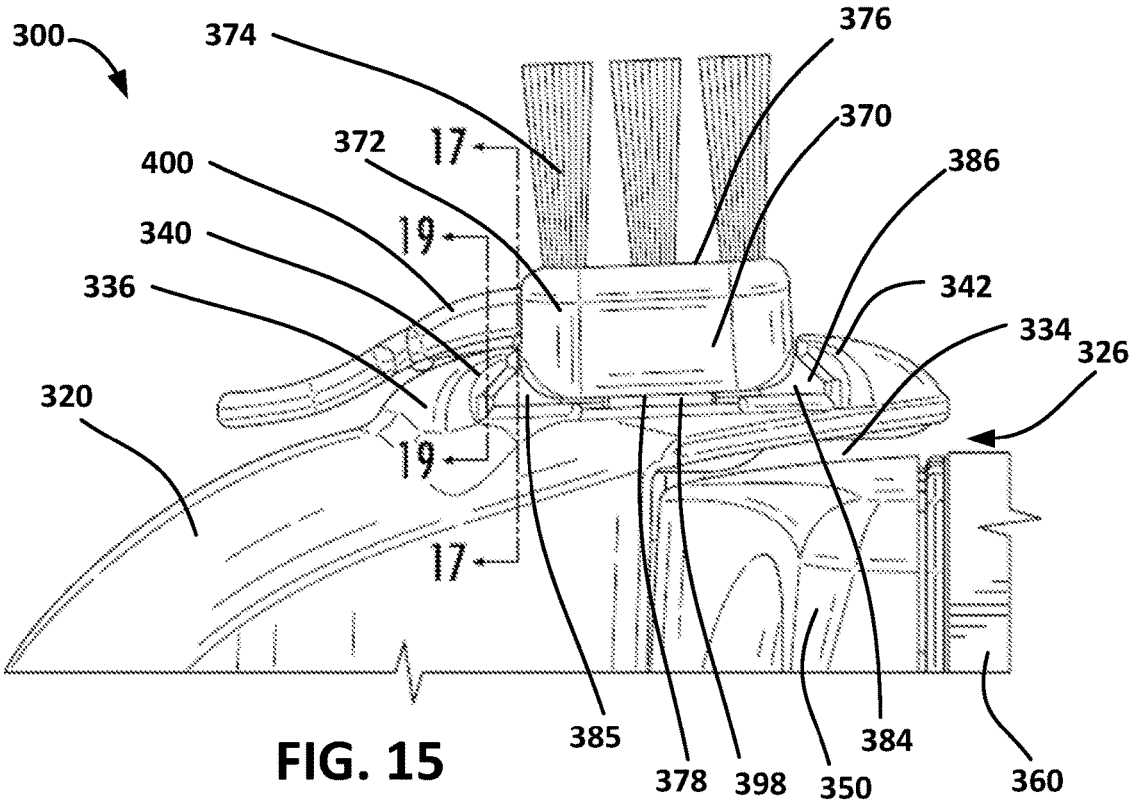
FIG. 15 illustrates a side view of a portion of the exemplary cleaning implement of FIG. 14, according to one or more aspects described herein.
Figure 16:
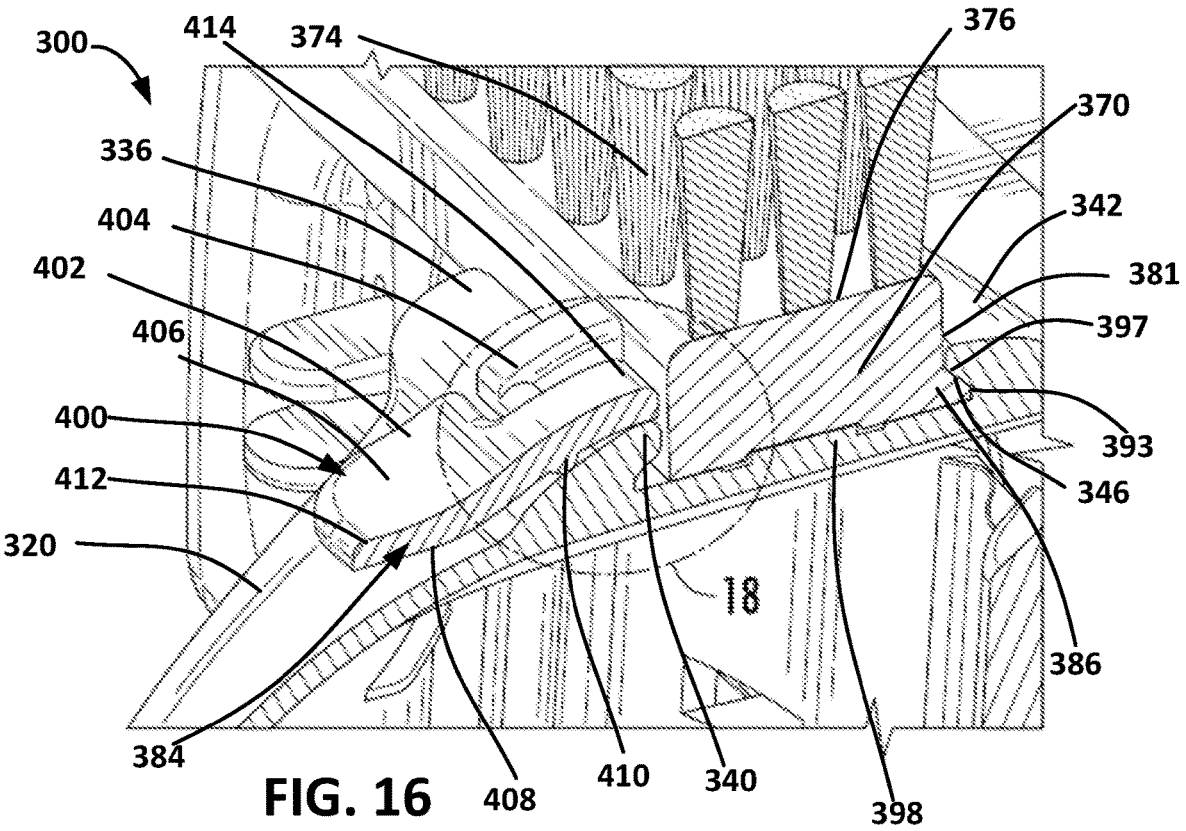
FIG. 16 illustrates a cross-sectional perspective view of the exemplary cleaning implement of FIG. 14 along the line 16-16, according to one or more aspects described herein.
Figure 17:
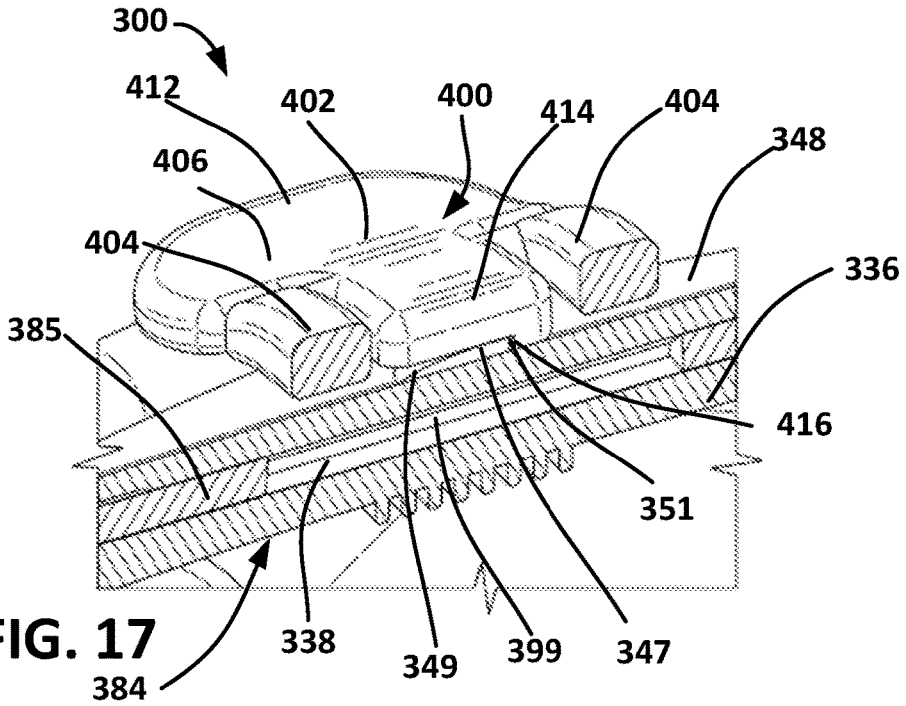
FIG. 17 illustrates a cross-sectional perspective view of the exemplary cleaning implement of FIG. 14 along the line 17-17 of FIG. 15, according to one or more aspects described herein.
Figure 18:
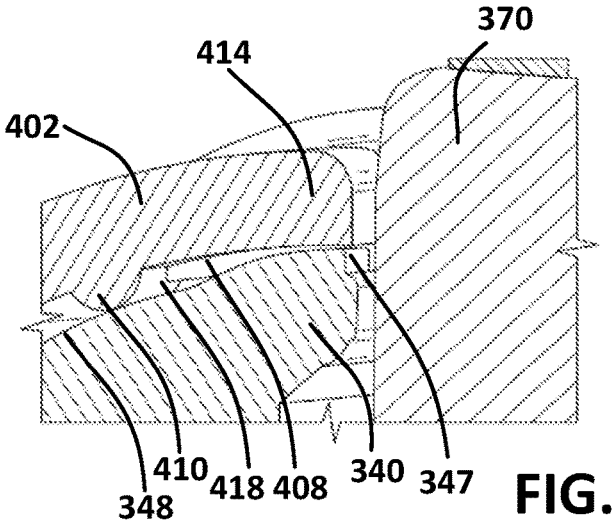
FIG. 18 illustrates an enlarged perspective cross-sectional view of a portion of the exemplary cross-sectional view of FIG. 14, according to one or more aspects described herein.
Figure 19:
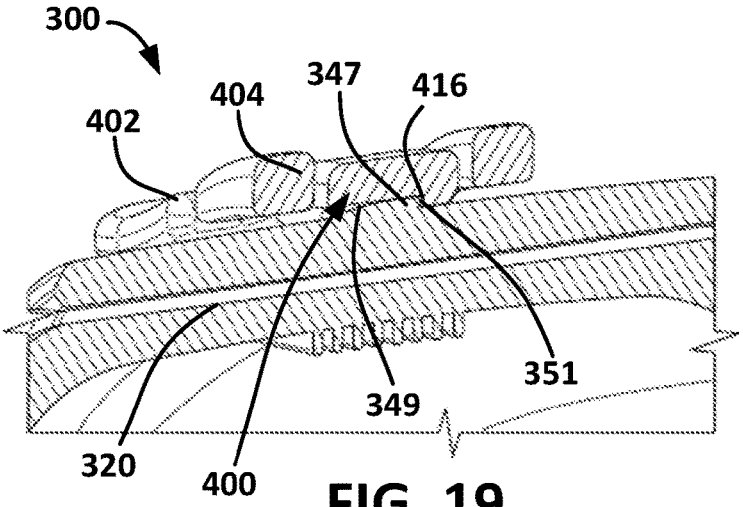
FIG. 19 illustrates a cross-sectional perspective view of the exemplary cleaning implement of FIG. 14 along the line 19-19 of FIG. 15, according to one or more aspects described herein.

As best illustrated in FIGS. 7-9, the connecting member 120 may have a front side 122, a rear side 124 opposite the front side 122, a right side 126 between the front side 122 and rear side 124, a left side 128 opposite the right side 126, a handle receiver 130 near a top of the connecting member 120, and a lower side 132 opposite the handle receiver 130.

The lower side 132 may include a primary receiver 134 that receives and secures the wringing mechanism 150. The front side 122 may include a secondary receiver 136, which may also be called a brush receiver 136. The brush receiver 136 may include a base surface 138, a first engaging member 140 extending from the front side 122 of the connecting member 120 above a first portion of the base surface 138, where a first slot or opening 143 may be created between the first engaging member 140 and the base surface 138, and a second engaging member 142 extending from the front side 122 of the connecting member 120 above a second portion of the base surface 138, where a second slot or opening 144 may be created between the second engaging member 142 and the base surface 138. The base surface 138 may be a substantially flat surface and may be a tiered surface with multiple levels. The first engaging member 140 may include an inward facing surface 145 that faces toward the base surface 138 and forms an acute angle with base surface 138. Similarly, the second engaging member 142 may include an inward facing surface 146 that faces toward the base surface 138 and forms an acute angle with base surface 138.

As best shown in FIGS. 10-13, the base structure 172 may include a rear side 178 opposite the front side 176, a top side 180 extending between the front side 176 and the rear side 178, a bottom side 181 opposite the top side 180, a first end 182 extending between the top side 180 and bottom side 181, and a second end 183 opposite the first end 182. The bristles 174 may be formed from one or more polymeric materials.

The first rail 185 may have a first rear surface 187, a first rail outboard surface 188, a pair of first rail inboard surfaces 189, where each first rail inboard surface 189 diverge from the first rail outboard surface 188, a pair of first rail guide surfaces 190 at each end of the first rail 185, and a first rail outward facing surface 191. Each first rail guide surface 190 may extend between the first rail outboard surface 188 and one of the first rail inboard surfaces 189, where each first rail guide surface 190 may form an acute angle with one of the first rail inboard surfaces 189. The first rail outward facing surface 191 may extend from the top side 180 of the base structure 172 towards the first rail outboard surface 188. The first rail outward facing surface 191 forms an acute angle with the first rear surface 187. The first rail outward facing surface 191 may confront or face toward the inward facing surface 145 of the first engaging member 140.

Similarly, the second rail 186 may have a second rail rear surface 192, a second rail outboard surface 193, a pair of second rail inboard surfaces 194, where each second rail inboard surface 194 diverges from the second rail outboard surface 193, a pair of second rail guide surfaces 195 at each end of the second rail 186, and a second rail outward facing surface 197. Each second rail guide surface 195 may extend between the second rail outboard surface 193 and one of the second rail inboard surfaces 194, where each second rail guide surface 195 may form an acute angle with one of the second rail inboard surfaces 194. The second rail outward facing surface 197 may extend from the bottom side 181 of the base structure 172 towards the second rail outboard surface 193. The second outward facing surface 197 may form an acute angle with the second rail rear surface 192. The second rail outward facing surface 197 may confront or face toward the inward facing surface 146 of the second engaging member 142. In addition, each of the rail guide surfaces 190, 195 may have a taper or chamfer to assist with steering the rails 185, 186 into their corresponding slot 143, 144. Similarly, each slot 143, 144 may have a tapered or chamfered surface at each end to help steer the corresponding rail 185, 186 into its appropriate slot.

The first rail outboard surface 188 and the second rail outboard surface 193 may be generally parallel to each other. A rail distance, D1, may be greater than a brush width, where the rail distance, D1, may be defined as a minimum distance between the first outboard surface and the second outboard surface. In addition, a pair of ribs 198 may connect the first rail 185 and second rail 186. The ribs 198 may extend generally perpendicular to the rail outboard surfaces 188, 193. The ribs 198 may help to further strengthen and support the rails 185, 186. In some examples, the first rail 185 may have a central recess 199 that coincides with the location of the tab assembly 200. For example, a width, W1, of the central recess 199 may be greater than a width, W2, of the tab assembly 200.

Each rail 185, 186 may be flexible such that each rail 185, 186 may deform slightly as the rails 185, 186 are slid into the openings 143, 144. Alternatively, the rails 185, 186 may freely slide within openings 143, 144.

As discussed above, the attachment structure 184 of the scrubbing brush 170 may also include a tab assembly 200 that extends from the base structure 172 of the scrubbing brush 170 to engage the retention member 147 to secure the scrubbing brush 170 to the secondary receiver 136. The engagement of the tab assembly 200 and the retention member 147 combined with the engagement of the rails 185, 186 and the openings 143, 144 of the secondary receiver 136 may secure the scrubbing brush 170 to the connecting member 120.

The tab assembly 200 may include a pivoting tab 202 that is pivotally connected to an arm or pair of arms 204. The pivoting tab 202 may include an upper surface 206, a lower surface 208, and a pivot member 210 that extends from the lower surface 208 of the pivoting tab 202. The tab 202 may have a first end 212 located furthest from the base structure 172 and have a second end 214 opposite the first end 212 nearest the base structure 172. The pivot member 210 may be located between the first end 212 and the second end 214. In addition, the pivot member 210 may contact the outward facing surface 148 of the secondary receiver 136 creating a gap 218 between the lower surface 208 and the outward facing surface 148 of the secondary receiver 136. The lower surface 208 may include a pocket 216 near second end 214. When the scrubbing brush 170 is secured to the connecting member 120, the retention member 147 may be received in the pocket 216. For a user to remove the scrubbing brush 170, a user may press downward on the upper surface 206 of the tab 202 on the first end 212 opposite the end with the pocket 216. The downward force on first end 212 may cause the tab 202 to pivot downward at first end 212 and to move upward at second end 214. The upward movement of second end 214 disengages the pocket 216 from the retention member 147 to allow the scrubbing brush 170 to be slid out of the secondary receiver 136. To reattach the scrubbing brush 170 to the connecting member 120, the rails 185, 186 may be inserted back into openings 143, 144. As the tab 202 of the scrubbing brush 170 approaches the retention member 147, a user may apply a downward force onto the first end 212 of tab 202 to cause the second end 214 to move upward and allow second end 214 to move the pocket 216 over the retention member 147. Once the pocket 216 is over the retention member 147, the user may remove the pressure/force on the first end 212 to allow the second end 214 to move downward causing the retention member 147 to be secured within the pocket 216. Example mop system 100 may allow for the scrubbing brush 170 to be slid laterally into the secondary receiver in either of two directions.

It is contemplated that the scrubbing brush 170 may be formed from any polymeric material, or a combination of materials. For example, the scrubbing brush 170 may be formed from two or more polymers, or a fiber reinforced polymer or polymers, among others. It is also contemplated that the base structure 172 may be formed using any manufacturing processes, including, injection molding. These bristles 174 may be formed from one or more polymeric materials. The base structure 172 and the attachment structure 184 (which includes the pair of rails 185, 186 and the tab assembly 200) of the scrubbing brush may be formed as a unitary member.

As stated above, the primary cleaning member 160 may be a sponge, a sponge based cleaning member, or other compressible member made from a water-absorbing porous or semi-porous material that connects to the wringing mechanism 150. The primary cleaning member 160 may be referred to as a mop head 160. The mop head 160 may be absorbent to allow the mop assembly 100 to pick up spills. The wringing mechanism 150 may then be used to squeeze the excess moisture from the mop head 160.

FIGS. 14-26 illustrate an alternate exemplary cleaning system or cleaning implement 300, according to one or more aspects described herein. The exemplary cleaning implement 300 may comprise a mop assembly 300 that includes a primary cleaning member 360 and a removable secondary cleaning member 370 that allows a user additional cleaning options. The mop assembly 300 may include a handle assembly 310 that connects to a connecting member 320, where the connecting member 320 may be configured to a wringing mechanism 350. The primary cleaning member 360 may be connected to the wringing mechanism 350, where the wringing mechanism 350 may be configured to wring the primary cleaning member 360 of any excess liquid by squeezing and/or folding the primary cleaning member 360. The secondary cleaning member 370 may be releasably secured to the connecting member 320 of the mop assembly 300. The primary cleaning member 360 may be a sponge based cleaning member, while the secondary cleaning member 370 may be a handheld cleaning member such as a scrubbing brush, a scrubbing pad, or similar cleaning member. In the illustrative examples, the secondary cleaning member 370 is shown as a scrubbing brush 370.

The mop assembly 300 may be used as a conventional mop to clean floors or other surfaces that require cleaning using the primary cleaning member 360. However, in situations where a surface may be difficult to clean, the removable scrubbing brush 370 may provide a user another option to effectively clean the surface while being easily retained by the mop assembly 300 to be readily available for use. As another option, the scrubbing brush 370 may be used while attached to the connecting member 320 of the mop assembly 300.

The handle assembly 310 of the cleaning implement 300 may include a handle member 312, with a lever 316 connected to the handle member 312. The handle member 312 may include a first end 314, a second end opposite the first end 314, where the first end 314 may be connected to a handle receiver 330 of the connecting member 320. A grip or similar member located on the handle member 312 nearer the second end may provide a place for a user's hands to easily grasp and use the mop assembly 300. The lever 316 may be connected to the wringing mechanism 350 and may be configured to control the movement of the wringing mechanism 350. For instance, the lever 316 may have a usage position where the wringing mechanism 350 allows the primary cleaning member 360 to be in a substantially flat or planar orientation to clean the intended surface and a wringing position, where the lever 316 may be pulled upward to cause the wringing mechanism 350 to squeeze and/or fold the ends 364, 366 of the primary cleaning member 360 toward each other to wring or squeeze any excess moisture, like water or cleaning solution, out of the primary cleaning member 360. The lever 316 may be connected to the wringing mechanism 350 via rods or cables that extend inside a hollow portion of the handle member 312 and a hollow portion of the connecting member 320. The handle member 312 may have an elongated shape and may be a lightweight hollow metal tube. Alternatively, any rigid structure formed from wood or a polymeric material may be used for the handle member 312.

FIGS. 15-19 illustrate the releasable connection between the secondary cleaning member 370 and the connecting member 320 of the mop assembly 300. The scrubbing brush 370 may include a base structure 372 with a plurality of bristles 374 that extend from a front side 376 of the base structure 372 and an attachment structure 384. The attachment structure 384 may allow the scrubbing brush 370 to be removably coupled to the connecting member 320 of the mop assembly 300. The attachment structure 384 may include a pair of rails 385, 386 along with a tab assembly 400, where each rail 385, 386 may be slidably engaged with the secondary receiver 336 of the connecting member 320. The pair of rails 385, 386 may include a first rail 385 arranged along the rear side 378 and/or the top side 380 of the base structure 372 and a second rail 386 may be arranged along the rear side 378 and/or the bottom side 381 of the base structure 372. For example, rail 385 may slidably engage with a first opening 343 created between a first engaging member 340 and a base surface 338 of the secondary receiver 336, and rail 386 may slidably engage with a second opening 344 created between a second engaging member 342 and the base surface 338. The two rails 385, 386 and two engaging members 340, 342 may be arranged on opposite sides of a central plane 373 of the scrubbing brush 370. In some cases, the two rails 385, 386 and the two engaging members 340, 342 may be mirror images relative to the central plane 373.

In order to limit the sliding movement of the scrubbing brush 370, a first retention member 347 may be located on an outward facing surface 348 of the first engaging member 340 of the secondary receiver 336 on the front side 322 of the connecting member 320 and a second retention member 339 that extends upward from base surface 338. The first retention member 347 may be a raised protrusion extending from the outward facing surface 348 of the secondary receiver 336. The first retention member 347 may have a ramped surface 349 on one side and an engaging surface 351 opposite the ramped surface 349. The engaging surface 351 may contact a stop surface 416 on the tab assembly 400. To secure the scrubbing brush 370 to the secondary receiver 336, the rails 385, 386 may be slid into their respective openings 343, 344. The scrubbing brush 370 is slid into the openings 343, 344 until the stop surface 420 of the central engagement member 398 contacts the second retention member 339 on the secondary receiver 336. The second retention member 339 may be a raised protrusion that extends from the base surface 338. In some examples, the second retention member 339 may have a polygonal shape, such as the illustrated rectangular shape, although the shape of the second retention member 339 may have any shape including a curved or circular shape. In addition, as the scrubbing brush 370 is slid into the secondary receiver the tab assembly 400 may slide up along the ramped surface 349 until the stop surface 416 reaches the engaging surface 351, where the tab assembly 400 drops into place such that the engaging surface 351 contacts and/or confronts the stop surface 416. The engagement of the first retention member 347 and the stop surface 416 may prevent the scrubbing brush 370 from moving laterally in a first direction, while the engagement of the second retention member 339 and the central engagement member 398 may prevent the scrubbing brush 370 from moving laterally in a second direction that is opposite the first direction. A center of the first retention member 347 and a center of the second retention member 339 may be substantially centered along a length, L1, of the first engaging member 340. Alternatively, the center of the retention member 347 and the center of the second retention member 339 may be offset, such that the center of the retention member 347 is closer to a first end of the first engaging member 340 than a second end of the first engaging member 340.

The scrubbing brush 370 may be releasably engaged to a front side 322 of the connecting member 320. In some examples, the scrubbing brush 370 may be releasably engaged to a rear side 324 or other side of the connecting member 320. The connecting member 320 may have a primary receiver 334 on a lower side 332.

Figure 20:
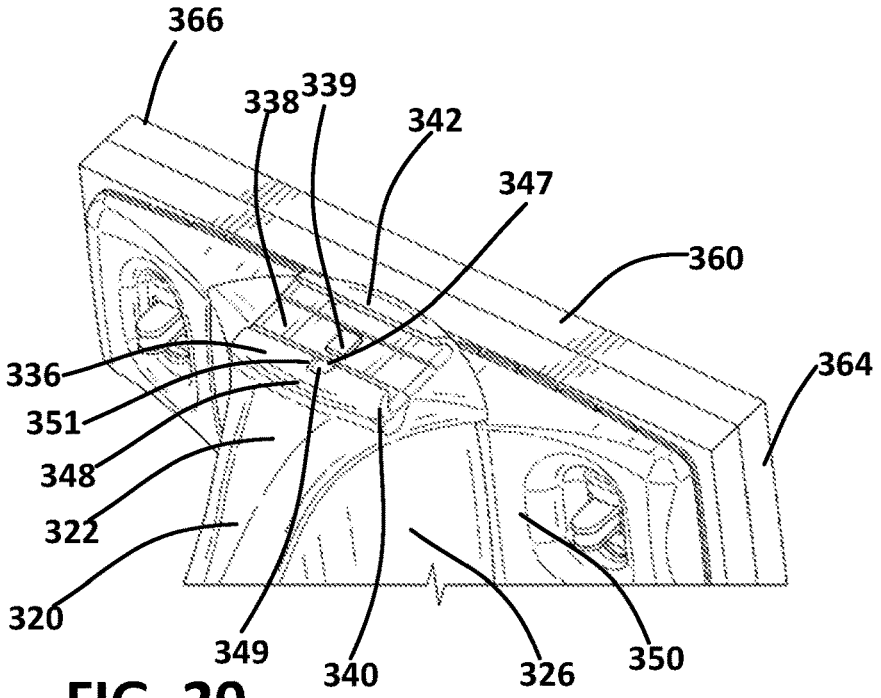
FIG. 20 illustrates a perspective view of a portion of a mop component of the exemplary cleaning implement of FIG. 14, according to one or more aspects described herein.
Figure 21:
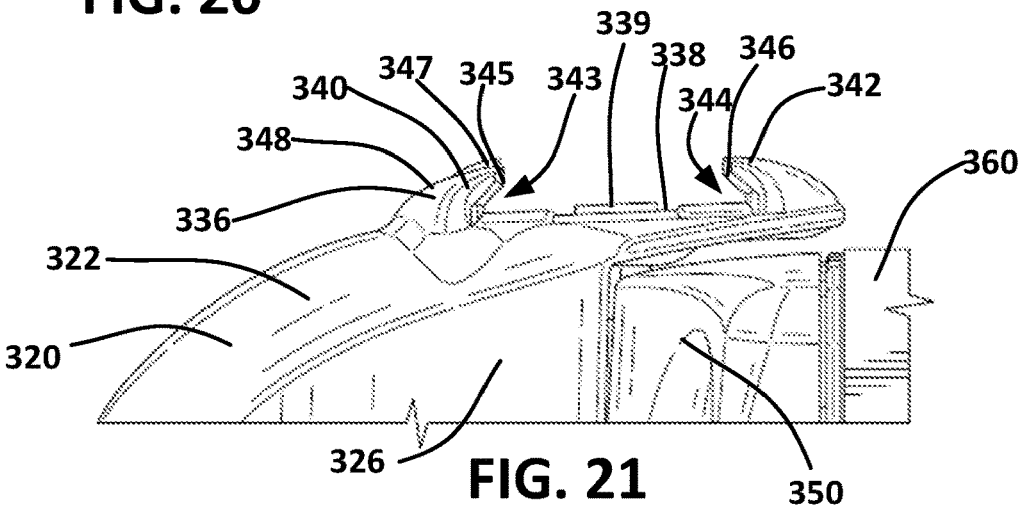
FIG. 21 illustrates a side view of a portion of a mop component of FIG. 20, according to one or more aspects described herein.
Figure 22:
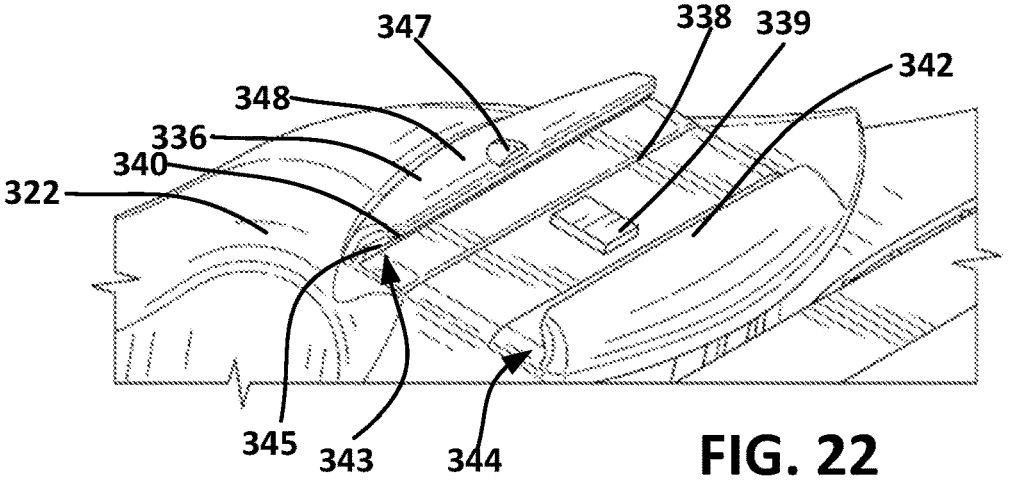
FIG. 22 illustrates a perspective view of a portion of a mop component of FIG. 20, according to one or more aspects described herein.
Figure 23:
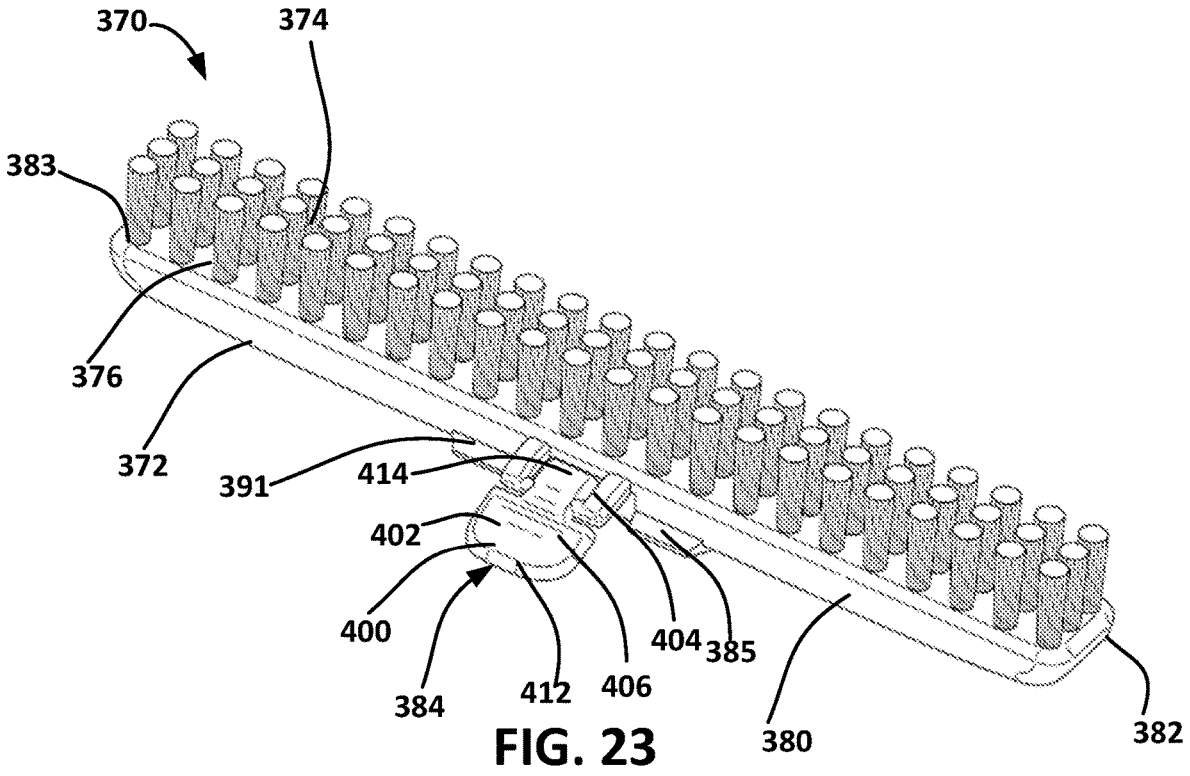
FIG. 23 illustrates a perspective view of a scrubbing brush component of the exemplary cleaning implement of FIG. 15, according to one or more aspects described herein.
Figure 24:
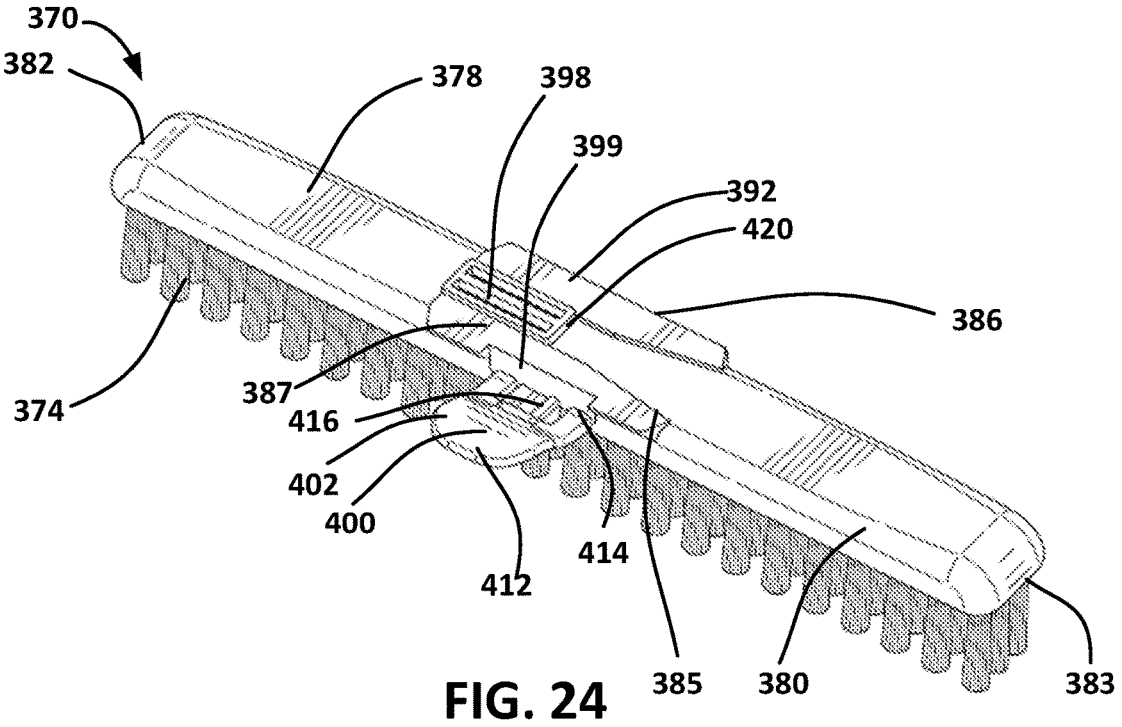
FIG. 24 illustrates a perspective view of the scrubbing brush component of FIG. 23, according to one or more aspects described herein.
Figure 25:
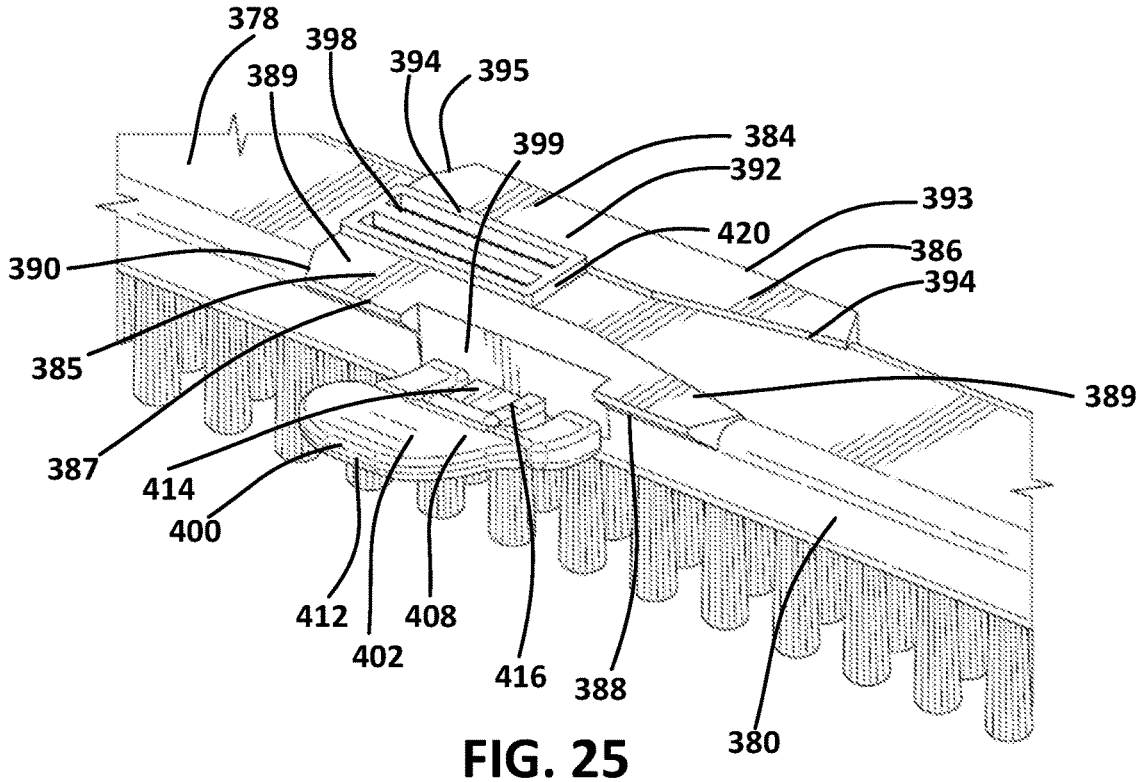
FIG. 25 illustrates an enlarged perspective view of a portion of a scrubbing brush component of FIG. 22, according to one or more aspects described herein.
Figure 26:
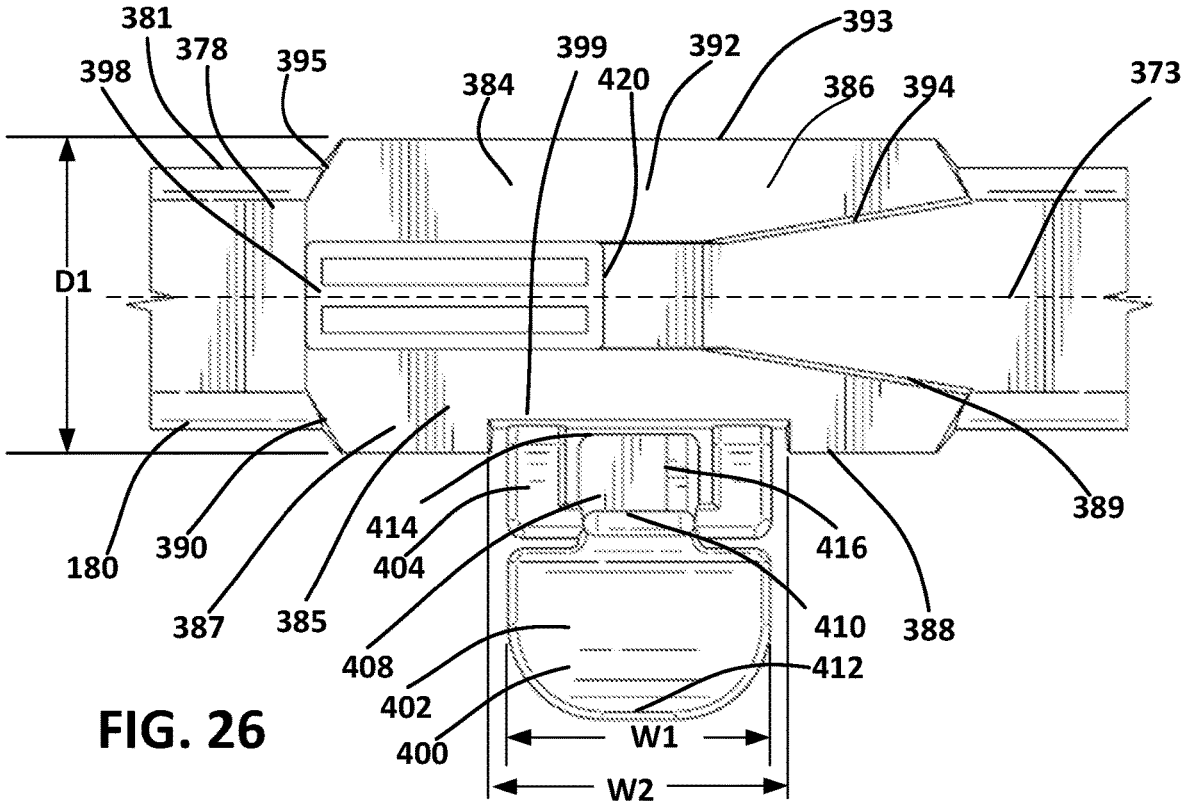
FIG. 26 illustrates a top view of a portion of a scrubbing brush component of FIG. 22, according to one or more aspects described herein.

As best illustrated in FIGS. 20-22, the connecting member 320 may have a front side 322, a rear side 324 opposite the front side 322, a right side 326 between the front side 322 and rear side 324, a left side 328 opposite the right side 326, a handle receiver 330 near a top of the connecting member 320, and a lower side 332 opposite the handle receiver 330. The lower side 332 may include a primary receiver 334 that receives and secures the wringing mechanism 350. The front side 322 may include a secondary receiver 336, which may also be called a brush receiver 336. The brush receiver 336 may include a base surface 338, a secondary retention member 339, a first engaging member 340 extending from the front side 322 of the connecting member 320 above a first portion of the base surface 338, where a first slot or opening 343 may be created between the first engaging member 140 and the base surface 338, and a second engaging member 342 extending from the front side 322 of the connecting member 320 above a second portion of the base surface 338, where a second slot or opening 344 may be created between the second engaging member 342 and the base surface 338. The first engaging member 340 may include an inward facing surface 345 that faces toward the base surface 338 and forms an acute angle with base surface 338. Similarly, the second engaging member 342 may include an inward facing surface 346 that faces toward the base surface 338 and forms an acute angle with base surface 338.

As best shown in FIGS. 23-26, the base structure 372 may include a rear side 378 opposite the front side 376, a top side 380 extending between the front side 376 and the rear side 378, a bottom side 381 opposite the top side 380, a first end 382 extending between the top side 380 and bottom side 381, and a second end 383 opposite the first end 382. The bristles 374 may be formed from one or more polymeric materials.

The first rail 385 may include a first rear surface 387, a first rail outboard surface 388, a pair of first rail inboard surfaces 389, where each first rail inboard surface 189 diverge from the first rail outboard surface 388, a first rail guide surface 390 at an end of the first rail 385, and a first rail outward facing surface 391. The first rail guide surface 390 may extend between the first rail outboard surface 388 and a first rail inboard surfaces 389. In some examples, the first rail guide surface 390 may be at the end of the first rail 385 that is nearer to the second end 383. In addition, the first rail guide surface 390 may form an acute angle with the first rail inboard surface 389. The first outward facing surface 391 may extend from the top side 380 of the base structure 372 towards the first rail outboard surface 388. The first rail outward facing surface 391 forms an acute angle with the first rear surface 387. The first rail outward facing surface 391 may confront or face toward the inward facing surface 345 of the first engaging member 340.

Similarly, the second rail 386 may include a second rail rear surface 392, a second rail outboard surface 393, a pair of second rail inboard surfaces 394, where each second rail inboard surface 394 diverges from the second rail outboard surface 393, a second rail guide surfaces 395 at an end of the second rail 386, and a second rail outward facing surface 397. In some examples, the first rail guide surface 395 may be at the end of the first rail 386 that is nearer to the second end 383. The second rail guide surface 395 may extend between the second rail outboard surface 393 and a second rail inboard surfaces 394. Additionally, the second rail guide surface 395 may form an acute angle with the second rail inboard surface 394. The second rail outward facing surface 397 may extend from the bottom side 381 of the base structure 372 towards the second rail outboard surface 393. The second outward facing surface may form an acute angle with the second rail rear surface 392. The second rail outward facing surface 397 may confront or face toward the inward facing surface 346 of the second engaging member 342. In addition, each of the guide surfaces 390, 395 may have a taper or chamfer to assist with steering the rails 385, 386 into its corresponding slot 343, 344. Similarly, each slot 343, 344 may have a tapered or chamfered surface at each end to help steer the corresponding rail 385, 386 into its appropriate slot.

The first rail outboard surface 388 and the second rail outboard surface 393 may be generally parallel to each other. A rail distance, D1, may be greater than a brush width, wherein the rail distance is a minimum distance between the first outboard surface and the second outboard surface. In addition, the central engagement member 398 may connect the first rail 385 and second rail 386. The central engagement member 398 may extend generally perpendicular to the rail outboard surfaces 388, 393. The central engagement member 398 may include a stop surface 420 that contacts the second retention member 339 on the secondary receiver 336. As shown in the illustrated example, the stop surface 420 may be generally planar, but in other examples, the stop surface may be non-planar, such as curved surface that is concave or convex. The central engagement member 398 may be substantially rectangular or may have a different shape such as triangular, circular, or other shape known to one skilled in the art. The central engagement member 398 may help to further strengthen and support the rails 385, 386. In some examples, the first rail 385 may have a central recess 399 that coincides with the location of the tab assembly 400. For example, a width, W1, of the central recess 399 may be greater than a width, W2, of the tab assembly 400.

Each rail 385, 386 may be flexible such that each rail 385, 386 may deform slightly as the rails 385, 386 are slid into the openings 343, 344. Alternatively, the rails 385, 386 may freely slide within openings 343, 344.

As discussed above, the attachment structure 384 of the scrubbing brush 370 may also include a tab assembly 400 that extends from the base structure 372 of the scrubbing brush 370 to engage the first retention member 347 to secure the scrubbing brush 370 laterally in a first direction to the secondary receiver 336, while the engagement of the second retention member 339 and the central engagement member 398 may constrain the scrubbing brush 370 laterally in a second direction opposite the first direction. Further, the engagement of the rails 385, 386 with the openings 343, 344 help to constrain the scrubbing brush 370 in a vertical direction and also in a forward and rearward direction. In short, the engagement of the tab assembly 400 and the first retention member 347 and the engagement of the central engagement member 398 with the second retention member 339 combined with the engagement of the rails 385, 386 and the openings 343, 344 of the secondary receiver 336 may secure the scrubbing brush 370 to the connecting member 320. While the scrubbing brush 370 is connected to the connecting member 320, the scrubbing brush 370 may be able to move slightly. For example, the scrubbing brush 370 may be able to move less than 1 mm or less 2 mm laterally.

The tab assembly 400 may include a pivoting tab 402 that is pivotally connected to an arm or pair of arms 404. The pivoting tab 402 may include an upper surface 406, a lower surface 408, and a pivot member 410 that extends from the lower surface 408 of the pivoting tab 402. The tab 402 may have a first end 412 located furthest from the base structure 372 and have a second end 414 opposite the first end 412 nearest the base structure 372. The pivot member 410 may be located between the first end 212 and the second end 414. In addition, the pivot member 410 may contact the outward facing surface 348 of the secondary receiver 436 creating a gap 418 between the lower surface 208 and the outward facing surface 348 of the secondary receiver 336. The lower surface 408 may include a stop surface 416 near second end 414. The stop surface 416 may extend from the lower surface 408 of the pivoting tab 402. When the scrubbing brush 170 is secured to the connecting member 320, the first retention member 347 may contact and/or confront the stop surface 416. For a user to remove the scrubbing brush 170, a user may press downward on the upper surface 406 of the tab 402 on the first end 412 opposite the end with the stop surface 416. The downward force on first end 412 may cause the tab 402 to pivot downward at first end 412 and to move upward at second end 414. The upward movement of second end 414 allows the stop surface 416 to pass over the first retention member 347 when the scrubbing brush is slid laterally in a first direction out of the secondary receiver 336. To reattach the scrubbing brush 370 to the connecting member 320, the rails 385, 386 may be inserted back into openings 343, 344 in a second lateral direction. As the tab 402 of the scrubbing brush 370 approaches the retention member 347, an outer surface of the tab 402 slides up the ramped surface 349 until the stop surface 416 passes the stop surface 351 at which point the tab 402 will lower putting the stop surface 416 into a position to confront the stop surface 351 of the first retention member 347. The scrubbing brush 370 may continue to move in a second lateral direction until the central engagement member 398 contacts the second retention member 339. Example mop system 300 may allow for the scrubbing brush 370 to be slid laterally into the secondary receiver in only one direction. Once secured to the secondary receiver 336, the scrubbing brush 370 may have less than 1 mm or in some cases less than 2 mm of play in any direction.

It is contemplated that the scrubbing brush 370 may be formed from any polymeric material, or a combination of materials. For example, the scrubbing brush 370 may be formed from two or more polymers, or a fiber reinforced polymer or polymers, among others. It is also contemplated that the base structure 372 may be formed using any manufacturing processes, including, injection molding. These bristles 374 may be formed from one or more polymeric materials. The base structure 372 and the attachment structure 384 (which includes the pair of rails 385, 386 and the tab assembly 400) of the scrubbing brush may be formed as a unitary member.

As stated above, the primary cleaning member 360 may be a sponge, a sponge based cleaning member, or other compressible member made from a water-absorbing porous or semi-porous material that connects to the wringing mechanism 350. The primary cleaning member 360 may be referred to as a mop head 360. The mop head 360 may be absorbent to allow the mop assembly 100 to pick up spills. The wringing mechanism 350 may then be used to squeeze the excess moisture from the mop head 360.

Aspects of the disclosure have been described in terms of illustrative examples thereof. Numerous other examples, modifications, and variations within the scope and spirit of the appended claims will occur to persons of ordinary skill in the art from a review of this disclosure. For example, an exemplary mop system as described herein may include features that combine features of the mop systems described herein or some features may be optional in accordance with aspects of the disclosure.

What is claimed is:

1. A mop assembly comprising:

a handle assembly, the handle assembly including a handle member having a first end and a second end opposite the first end;

a connecting member having a handle receiver connected to the first end of the handle member; the connecting member having a front side, a rear side opposite the front side, and a bottom side between the front side and the rear side arranged opposite the handle receiver;

wherein the bottom side includes a primary receiver and the front side includes a brush receiver;

a wringing mechanism connected to the primary receiver;

a flexible cleaning member connected to the primary receiver, wherein the wringing mechanism is configured to wring any excess moisture from the flexible cleaning member; and a scrubbing brush releasably attached to the brush receiver, wherein the scrubbing brush includes a base structure and an attachment structure, wherein the attachment structure of the scrubbing brush includes a tab assembly connected to the base structure of the scrubbing brush and wherein a plurality of bristles extend from a front side of the base structure;

wherein the base structure further includes a rear side opposite the front side, a top side extending between the front side and the rear side, a bottom side opposite the top side, a first end extending between the top side and the bottom side, and a second end opposite the first end, and wherein the attachment structure includes a pair of rails located on a portion of the rear side of the base structure wherein the pair of rails comprises:

a first rail, the first rail having a first rear surface, a first outboard surface, a first inboard surface, wherein the first inboard surface diverges from the first outboard surface, and a second rail, the second rail having a second rear surface, a second outboard surface, a second inboard surface, wherein the second inboard surface diverges from the first outboard surface, and wherein the first outboard surface and the second outboard surface are generally parallel to each other; and wherein the first rail further includes a first guide surface that extends between the first outboard surface and the first inboard surface, wherein the first guide surface forms an acute angle with the first inboard surface; and wherein the brush receiver includes:

a base surface;

a first engaging member extending from the front side of the connecting member above a first portion of the base surface, wherein a first slot is created between the first engaging member and the base surface; and a second engaging member extending from the front side of the connecting member above a second portion of the base surface, wherein a second slot is created between the second engaging member and the base surface;

a first retention member located on an outward facing surface of the front side of the connecting member;

wherein the tab assembly engages the first retention member to help secure the scrubbing brush to the connecting member.

2. The mop assembly of claim 1, wherein the brush receiver further includes a second retention member that extends upward from the base surface of the brush receiver and the attachment structure includes a central engagement member that contacts the second retention member to help secure the scrubbing brush to the connecting member.

3. The mop assembly of claim 1, wherein the first rail has a first outward facing surface extending from the top side of the base structure towards the first outboard surface, and the second rail has a second outward facing surface extending from the bottom side of the base surface towards the second outboard surface, wherein the first outward facing surface forms a first acute angle with the first rear surface.

4. The mop assembly of claim 3, wherein when the scrubbing brush is slidably engaged with the brush receiver, the first outward facing surface confronts an inward facing surface of the first engaging member.

5. The mop assembly of claim 1, wherein the tab assembly comprises:

a pivoting tab with a first end located furthest from the base structure, a second end opposite the first end located nearest the base structure, an upper surface, a lower surface opposite the upper surface, and a pivot member extending from the lower surface, wherein the pivot member contacts the outward facing surface of the front side of the connecting member creating a gap between the lower surface of the pivoting tab and the outward facing surface of the brush receiver.

6. A mop assembly comprising:

a handle assembly, the handle assembly including a handle member having a first end and a second end opposite the first end;

a connecting member having a handle receiver connected to the first end of the handle member; the connecting member having a front side, a rear side opposite the front side, and a bottom side between the front side and the rear side arranged opposite the handle receiver;

wherein the bottom side includes a primary receiver and the front side includes a brush receiver;

a wringing mechanism connected to the primary receiver;

a flexible cleaning member connected to the primary receiver, wherein the wringing mechanism is configured to wring any excess moisture from the flexible cleaning member; and a scrubbing brush releasably attached to the brush receiver, wherein the scrubbing brush includes a base structure and an attachment structure, wherein the attachment structure of the scrubbing brush includes a tab assembly connected to the base structure of the scrubbing brush, and wherein a plurality of bristles extend from a front side of the base structure;

wherein the brush receiver includes:

a base surface;

a first engaging member extending from the front side of the connecting member above a first portion of the base surface, wherein a first slot is created between the first engaging member and the base surface; and a second engaging member extending from the front side of the connecting member above a second portion of the base surface, wherein a second slot is created between the second engaging member and the base surface;

a first retention member located on an outward facing surface of the front side of the connecting member;

wherein the tab assembly engages the first retention member to help secure the scrubbing brush to the connecting member;

wherein the tab assembly comprises:

a pivoting tab with a first end located furthest from the base structure, a second end opposite the first end located nearest the base structure, an upper surface, a lower surface opposite the upper surface, and a pivot member extending from the lower surface, wherein the pivot member contacts the outward facing surface of the front side of the connecting member creating a gap between the lower surface of the pivoting tab and the outward facing surface of the brush receiver; and wherein the first retention member is a raised protrusion extending from the outward facing surface of the brush receiver, and wherein the first retention member has a ramped surface and an engaging surface that confronts a stop surface on the pivoting tab.

7. A cleaning implement comprising:

a handle assembly, the handle assembly including an elongated handle member and a lever connected to the elongated handle member;

a connecting member having a handle receiver attached to an end of the elongated handle member; the connecting member having a front side, a rear side opposite the front side, a bottom side between the front side and the rear side arranged opposite the handle receiver;

wherein the bottom side includes a primary receiver and the front side includes a secondary receiver;

a wringing mechanism connected to the primary receiver of the connecting member, wherein movement of the wringing mechanism is controlled by the lever;

a primary cleaning member that is releasably engaged with the wringing mechanism, wherein the wringing mechanism is configured to wring any excess moisture from the primary cleaning member by folding a first end of the primary cleaning member toward a second end of the primary cleaning member; and a secondary cleaning member releasably attached to the secondary receiver, the secondary cleaning member having a base structure with a cleaning structure extending from a first side of the base structure, a pair of rails located on a second side of the base structure, and a tab assembly located on a third side of the base structure, wherein the third side is located between the first side and the second side, wherein the pair of rails slidably engage a pair of slots of the secondary receiver, the tab assembly engages a first retention member located on an outward facing surface of the secondary receiver to help secure the secondary cleaning member to the connecting member;

wherein the tab assembly comprises:

a pivoting tab with a first end located furthest from the base structure, a second end opposite the first end located nearest the base structure, an upper surface, a lower surface opposite the upper surface, and a pivot member extending from the lower surface, wherein the pivot member contacts an outward facing surface of the secondary receiver creating a gap between the lower surface and the outward facing surface of the secondary receiver; and wherein the first retention member is a raised protrusion extending from the outward facing surface of the secondary receiver, and wherein the first retention member is received in a pocket located in the lower surface of the pivoting tab.

8. The cleaning implement of claim 7, wherein the primary cleaning member is a sponge based cleaning member, and the secondary cleaning member is a scrubbing brush.

9. A cleaning implement comprising:

a handle assembly, the handle assembly including an elongated handle member and a lever connected to the elongated handle member;

a connecting member having a handle receiver attached to an end of the elongated handle member; the connecting member having a front side, a rear side opposite the front side, a bottom side between the front side and the rear side arranged opposite the handle receiver;

wherein the bottom side includes a primary receiver and the front side includes a secondary receiver;

a wringing mechanism connected to the primary receiver of the connecting member, wherein movement of the wringing mechanism is controlled by the lever;

a primary cleaning member that is releasably engaged with the wringing mechanism, wherein the wringing mechanism is configured to wring any excess moisture from the primary cleaning member by folding a first end of the primary cleaning member toward a second end of the primary cleaning member; and a secondary cleaning member releasably attached to the secondary receiver, the secondary cleaning member having a base structure with a cleaning structure extending from a first side of the base structure, a pair of rails located on a second side of the base structure, and a tab assembly located on a third side of the base structure, wherein the third side is located between the first side and the second side, wherein the pair of rails slidably engage a pair of slots of the secondary receiver, the tab assembly engages a first retention member located on an outward facing surface of the secondary receiver to help secure the secondary cleaning member to the connecting member; and wherein the secondary receiver includes:

a base surface;

a first engaging member extending from the first side above a first portion of the base surface, wherein a first slot of the pair of slots is created between the first engaging member and the base surface; and a second engaging member extending from the first side above a second portion of the base surface, wherein a second slot of the pair of slots is created between the second engaging member and the base surface, wherein the secondary receiver further includes a second retention member that extends upward from the base surface, and a central engagement member that contacts the second retention member to help secure the secondary cleaning member to the connecting member, wherein the central engagement member is located between the pair of rails.

10. A mop assembly comprising:

a handle assembly, the handle assembly including an elongated handle member and a lever connected to the elongated handle member;

a connecting member having a handle receiver attached to an end of the elongated handle member; the connecting member having a front side, a rear side opposite the front side, a bottom side between the front side and the rear side arranged opposite the handle receiver;

wherein the bottom side includes a primary receiver and the front side includes a brush receiver, the brush receiver includes:

a base surface;

a first engaging member extending from the front side of the connecting member above a first portion of the base surface, wherein a first slot of a pair of slots is created between the first engaging member and the base surface;

a second engaging member extending from the front side of the connecting member above a second portion of the base surface, wherein a second slot of the pair of slots is created between the second engaging member and the base surface;

a first retention member formed as a raised protrusion on an outward facing surface of the connecting member; and a second retention member extending upward from the base surface;

a wringing mechanism connected to the primary receiver of the connecting member, wherein movement of the wringing mechanism is controlled by the lever;

a sponge based cleaning member that is releasably engaged with the wringing mechanism, wherein the wringing mechanism is configured to wring any excess moisture from the sponge based cleaning member by folding a first end of the sponge based cleaning member toward a second end of the sponge based cleaning member; and a scrubbing brush releasably attached to the brush receiver, the scrubbing brush including:

a base structure with a plurality of bristles extending from a first side of the base structure, a pair of rails located on a second side of the base structure, a central engagement member located between the pair of rails, and a tab assembly located on a third side of the base structure, wherein the third side is located between the first side and the second side, and wherein the pair of rails of the scrubbing brush slidably engage the pair of slots of the brush receiver, the tab assembly engages the first retention member, and the central engagement member contacts the second retention member to secure the scrubbing brush to the connecting member.

11. The mop assembly of claim 10, wherein the base structure, the pair of rails, and the tab assembly of the scrubbing brush are formed as a unitary member.

12. The mop assembly of claim 10, wherein the tab assembly comprises:

a pivoting tab with a first end located furthest from the base structure, a second end opposite the first end located nearest the base structure, an upper surface, a lower surface opposite the upper surface, and a pivot member extending from the lower surface, wherein the pivot member contacts the outward facing surface of the connecting member creating a gap between the lower surface and the outward facing surface of the connecting member.

* * * * *